US011425972B2

(12) United States Patent
Ekko et al.

(10) Patent No.: US 11,425,972 B2
(45) Date of Patent: Aug. 30, 2022

(54) STOPPER AND SLIDE FASTENER COMPRISING SAME

(71) Applicant: YKK CORPORATION, Tokyo (JP)

(72) Inventors: Tomoyuki Ekko, Toyama (JP); Yu Chen Tung, Toyama (JP); Jiro Nozaki, Toyama (JP)

(73) Assignee: YKK CORPORATION, Tokyo (JP)

( * ) Notice: Subject to any disclaimer, the term of this patent is extended or adjusted under 35 U.S.C. 154(b) by 0 days.

(21) Appl. No.: 16/979,451

(22) PCT Filed: Mar. 12, 2018

(86) PCT No.: PCT/JP2018/009575
§ 371 (c)(1),
(2) Date: Sep. 9, 2020

(87) PCT Pub. No.: WO2019/175944
PCT Pub. Date: Sep. 19, 2019

(65) Prior Publication Data

US 2021/0007446 A1 Jan. 14, 2021

(51) Int. Cl.
*A44B 19/26* (2006.01)
*A44B 19/38* (2006.01)
*A44B 19/36* (2006.01)

(52) U.S. Cl.
CPC ..... *A44B 19/26* (2013.01); *A44B 19/36* (2013.01); *A44B 19/384* (2013.01)

(58) Field of Classification Search
CPC ..... A44B 19/26; A44B 19/36; A44B 19/384; A44B 19/38; A44B 19/303; A44D 2203/00
See application file for complete search history.

(56) References Cited

U.S. PATENT DOCUMENTS 9,027,210 B2 * 5/2015 Peters ..... A44B 99/00 24/433
10,292,461 B2 * 5/2019 Jin ..... A44B 19/04
(Continued)

FOREIGN PATENT DOCUMENTS

JP S55500279 A 5/1980
JP 2003334109 A 11/2003
(Continued)

OTHER PUBLICATIONS

International Preliminary Report on Patentability for related PCT application No. PCT/JP2018/009575, dated Sep. 15, 2020, Total 12 pages.

(Continued)

*Primary Examiner* — Robert Sandy
*Assistant Examiner* — Rowland Do
(74) *Attorney, Agent, or Firm* — Procopio, Cory, Hargreaves & Savitch LLP

(57) ABSTRACT

Stop member includes: a first member including a first insert to be inserted into a slider via a rear mouth of the slider, and a first base positioned rearward of the first insert; and a second member including a second insert to be inserted into the slider via a slit extending between the rear mouth and a front mouth of the slider, and a second base to be overlaid onto the first base. The first and second bases are configured to effect magnetic attraction and/or repulsion between the first and second bases when the first and second bases are overlaid. The second base rotates relative to the first base in accordance with the magnetic attraction and/or repulsion to allow the second insert to pivot toward the slit.

13 Claims, 28 Drawing Sheets

(56) References Cited

U.S. PATENT DOCUMENTS

| | | | | |
|---|---|---|---|---|
| 2003/0213106 | A1 | 11/2003 | Ichikawa et al. | |
| 2005/0050699 | A1 | 3/2005 | Yoneoka | |
| 2010/0313387 | A1* | 12/2010 | Peters ..... | A44B 19/38<br>24/381 |

FOREIGN PATENT DOCUMENTS

| | | | |
|---|---|---|---|
| JP | 2004248809 | A | 9/2004 |
| JP | 4152216 | B2 | 9/2008 |
| JP | 3170902 | U | 10/2011 |
| WO | 7900927 | A1 | 11/1979 |

OTHER PUBLICATIONS

International Search Report and Written Report for related PCT App No. PCT/JP2018/009575 dated May 15, 2018, 11 pgs.

* cited by examiner

[Fig. 1]
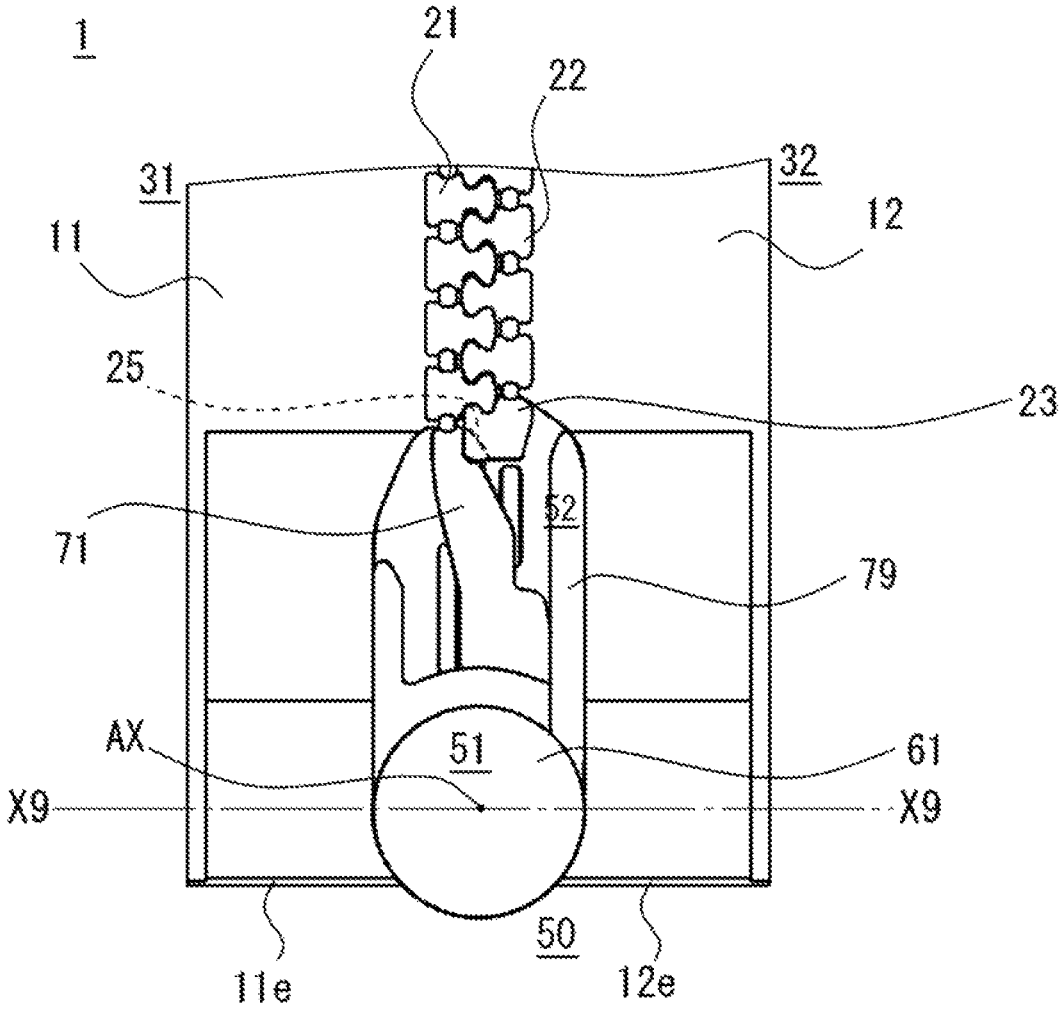

[Fig. 2]
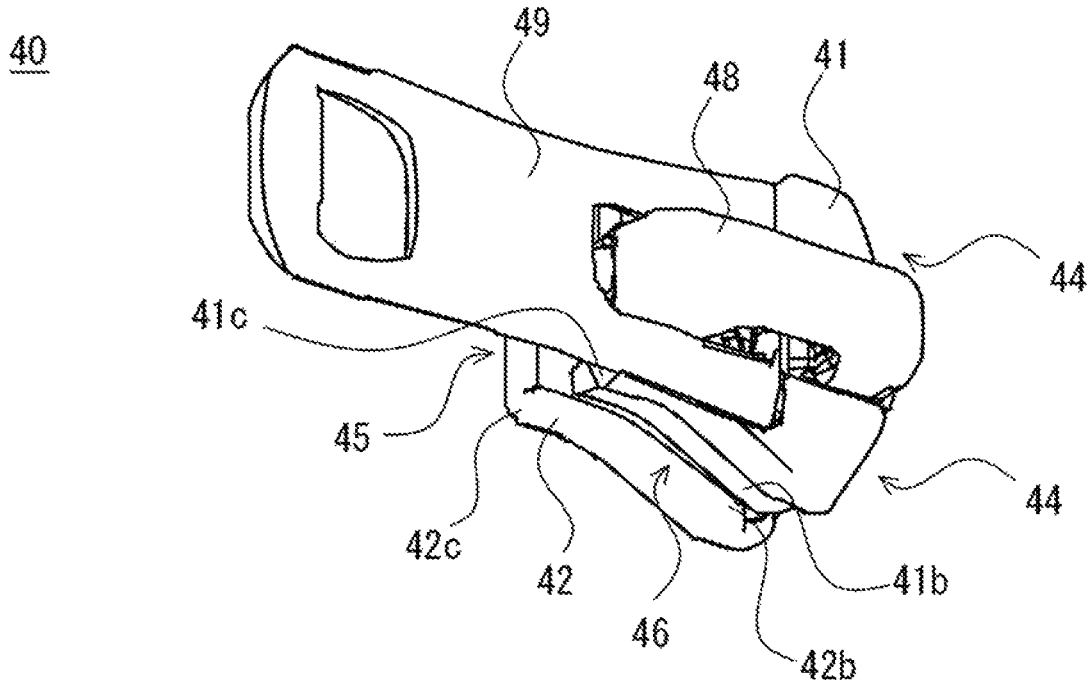
[Fig. 3]
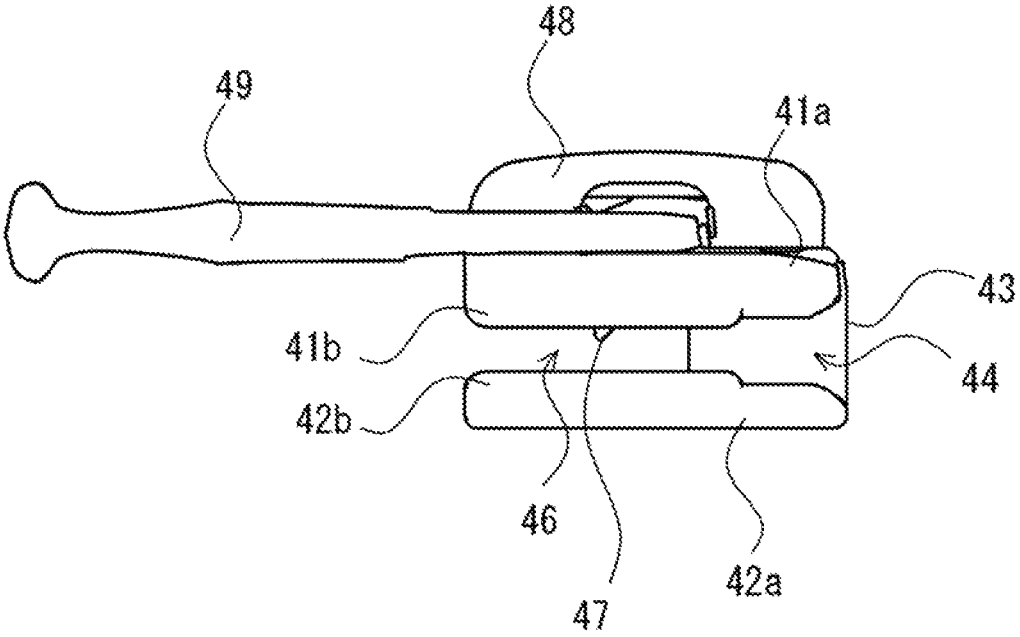

[Fig. 4]
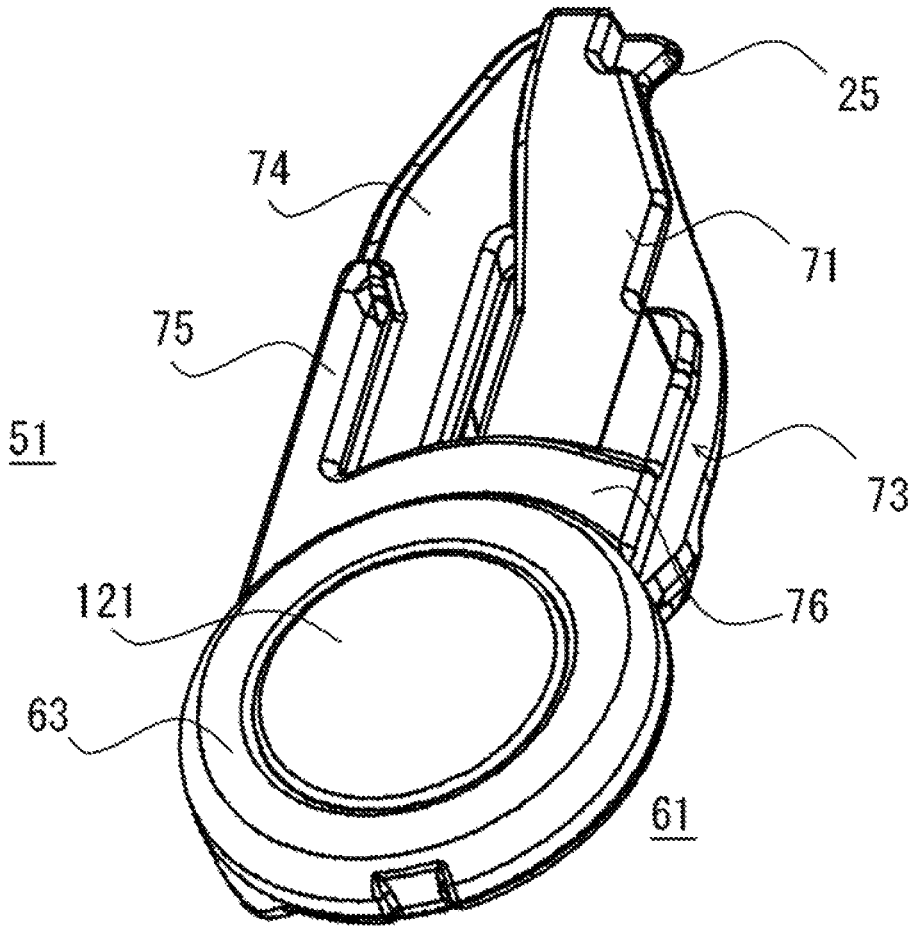

[Fig. 5]
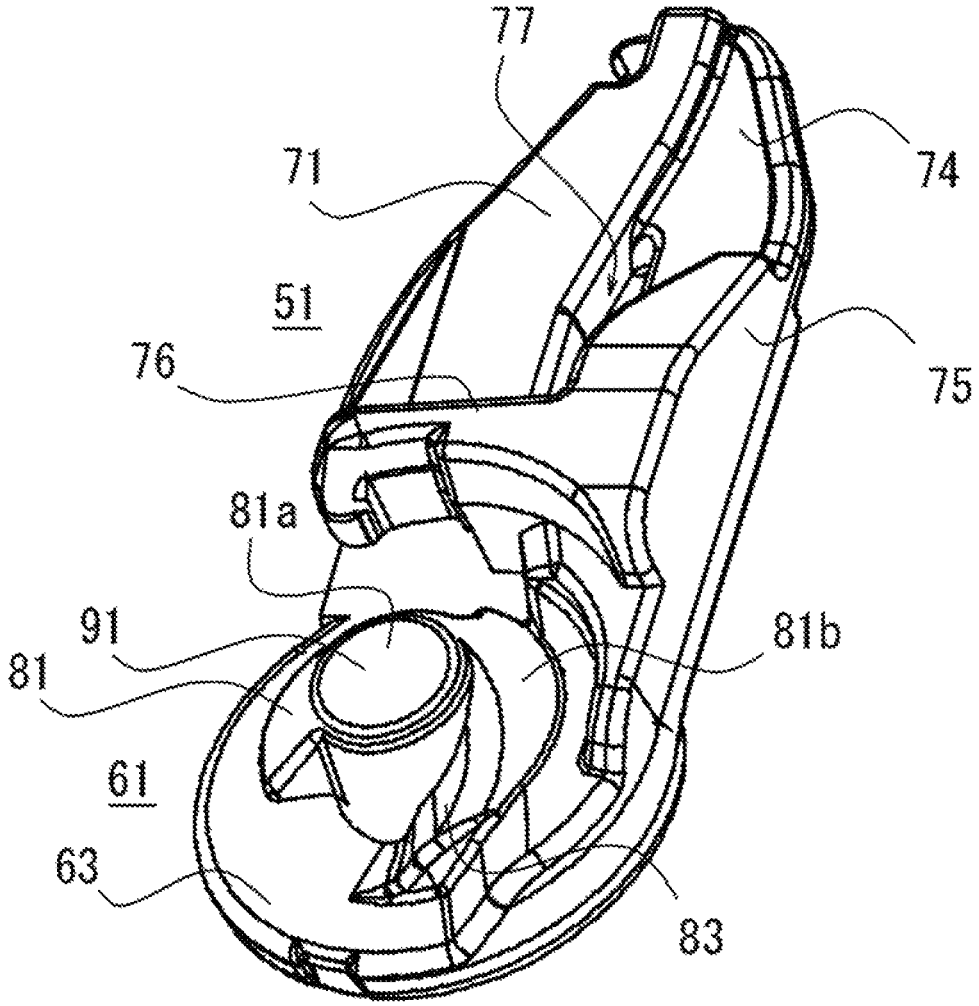

[Fig. 6]
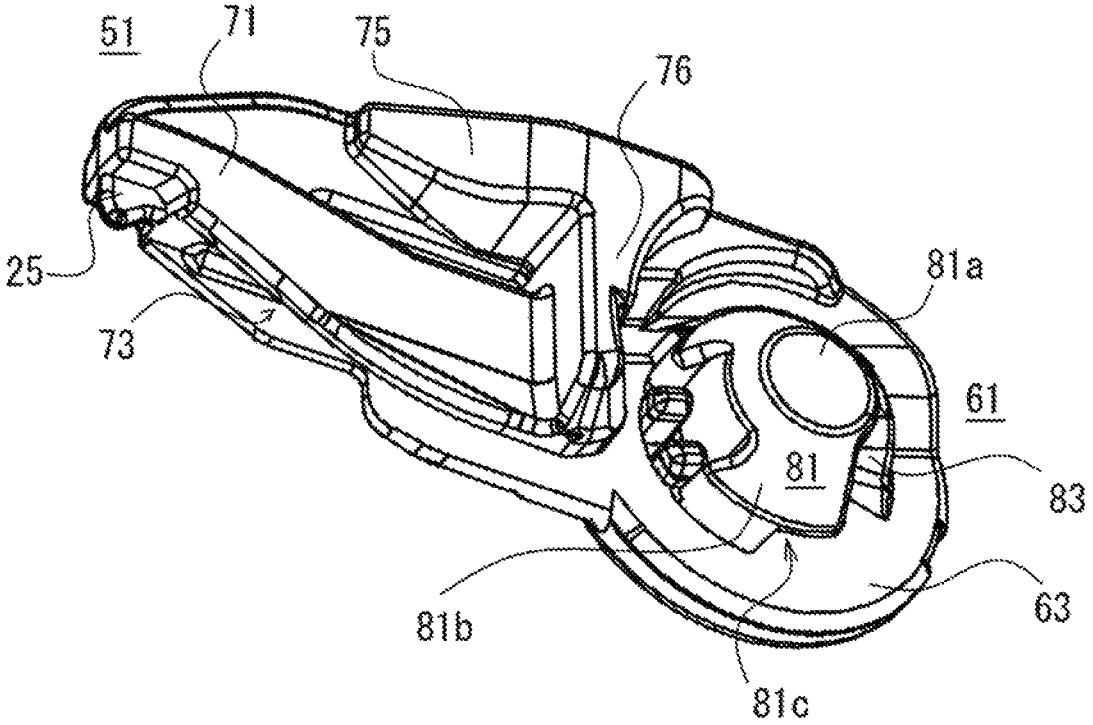

[Fig. 7]
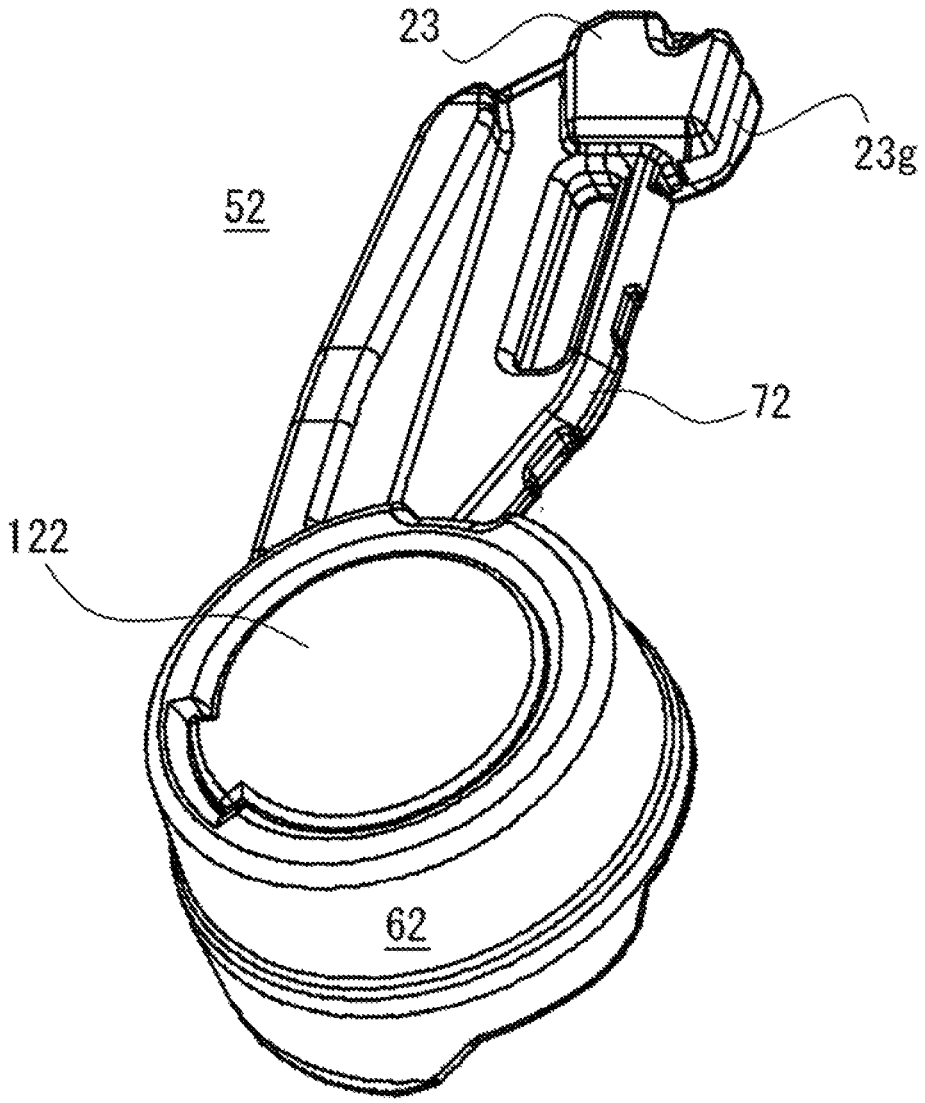

[Fig. 8]
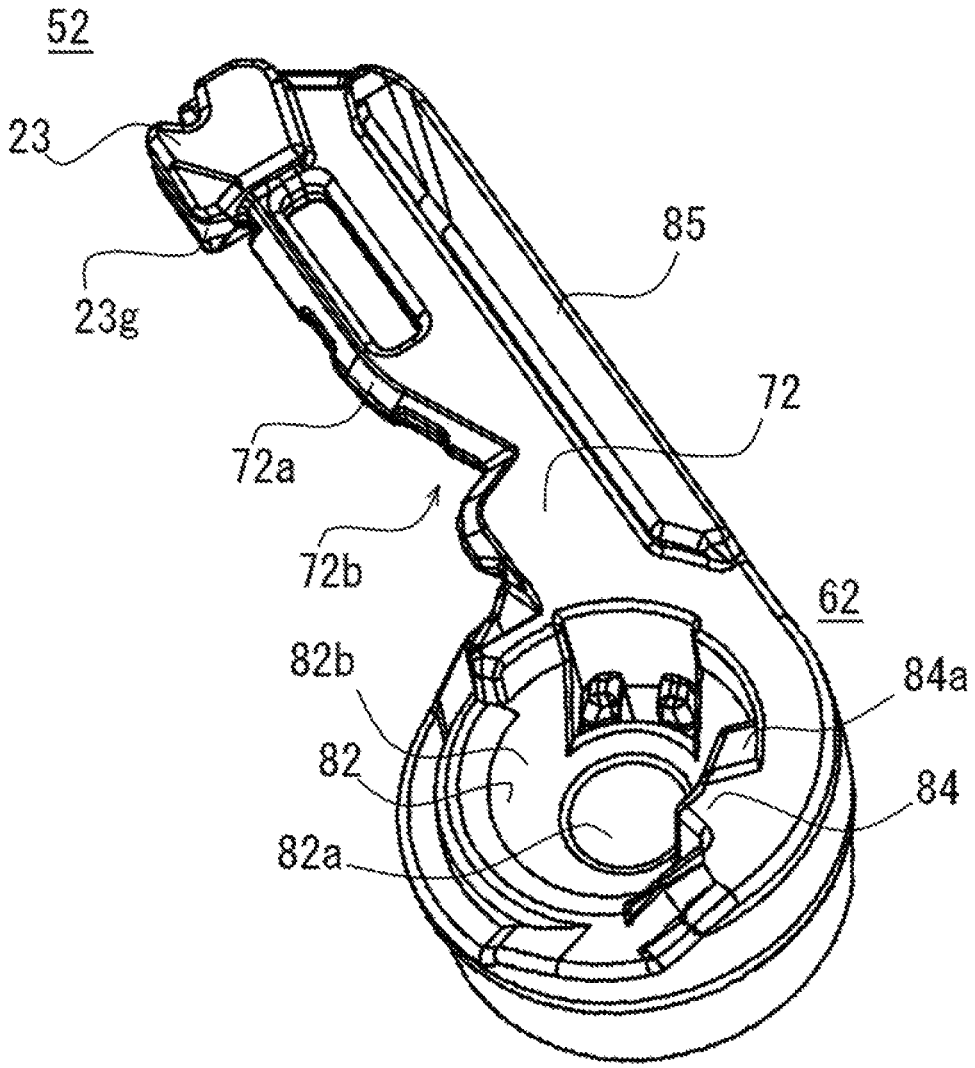

[Fig. 9]
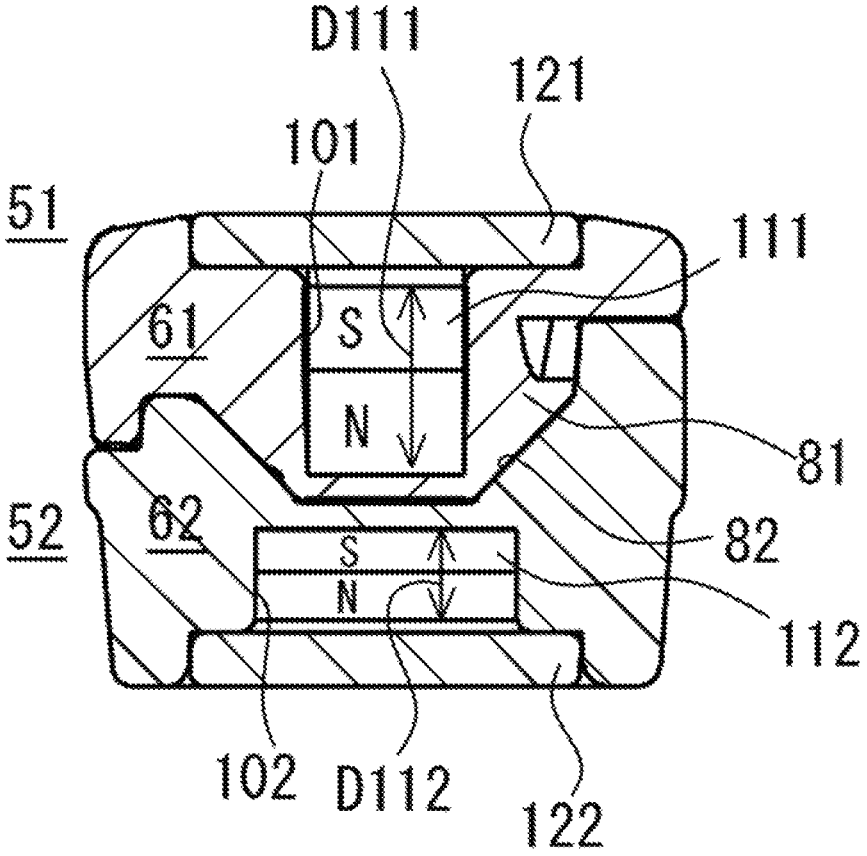

[Fig. 10]
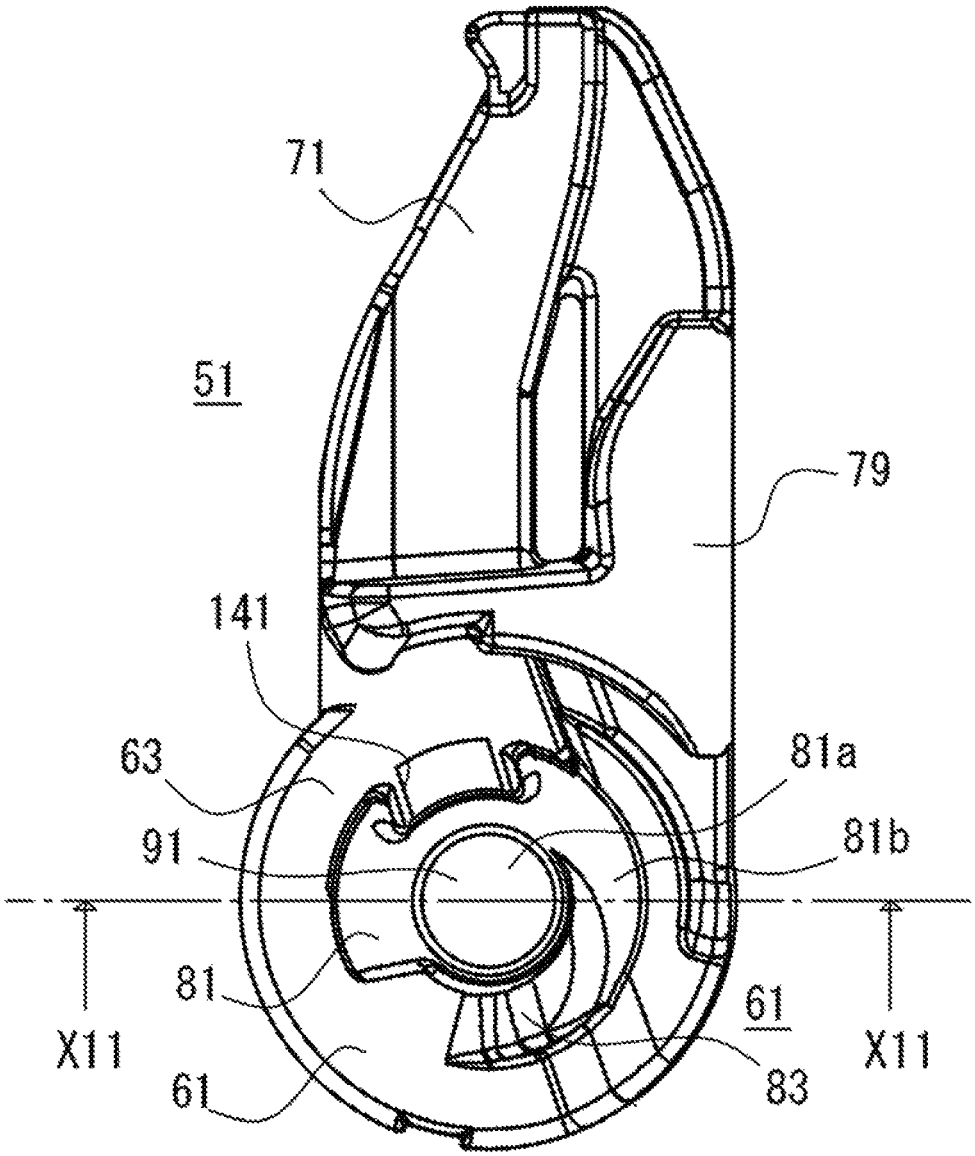

[Fig. 11]
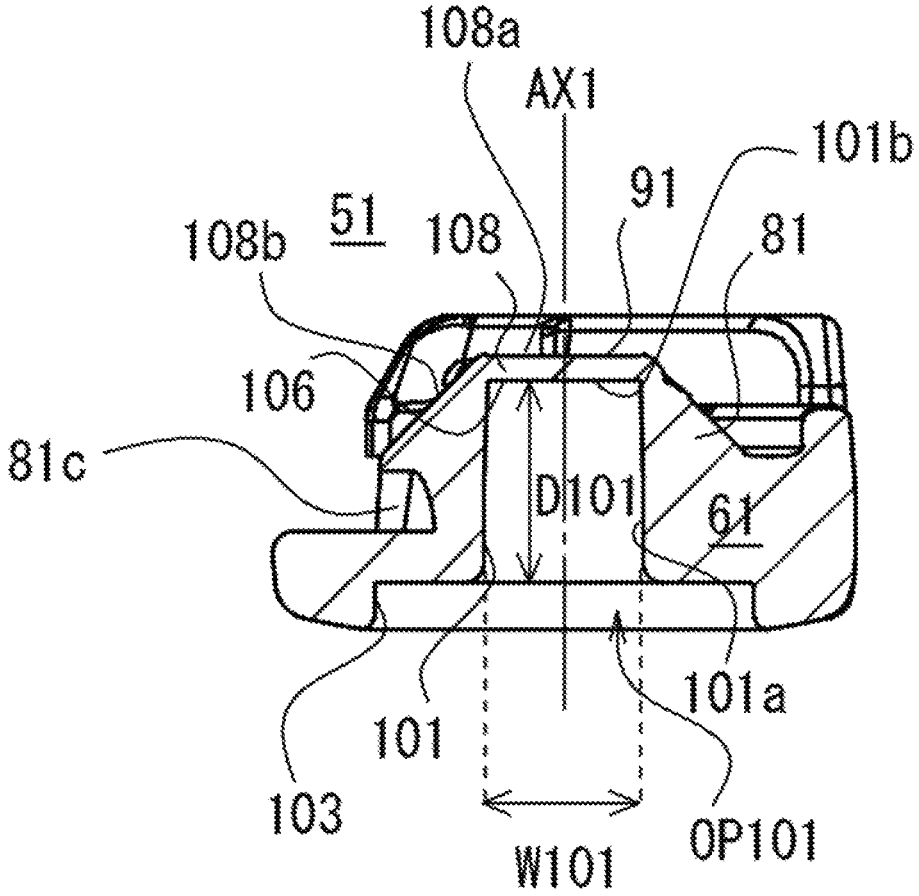

[Fig. 12]
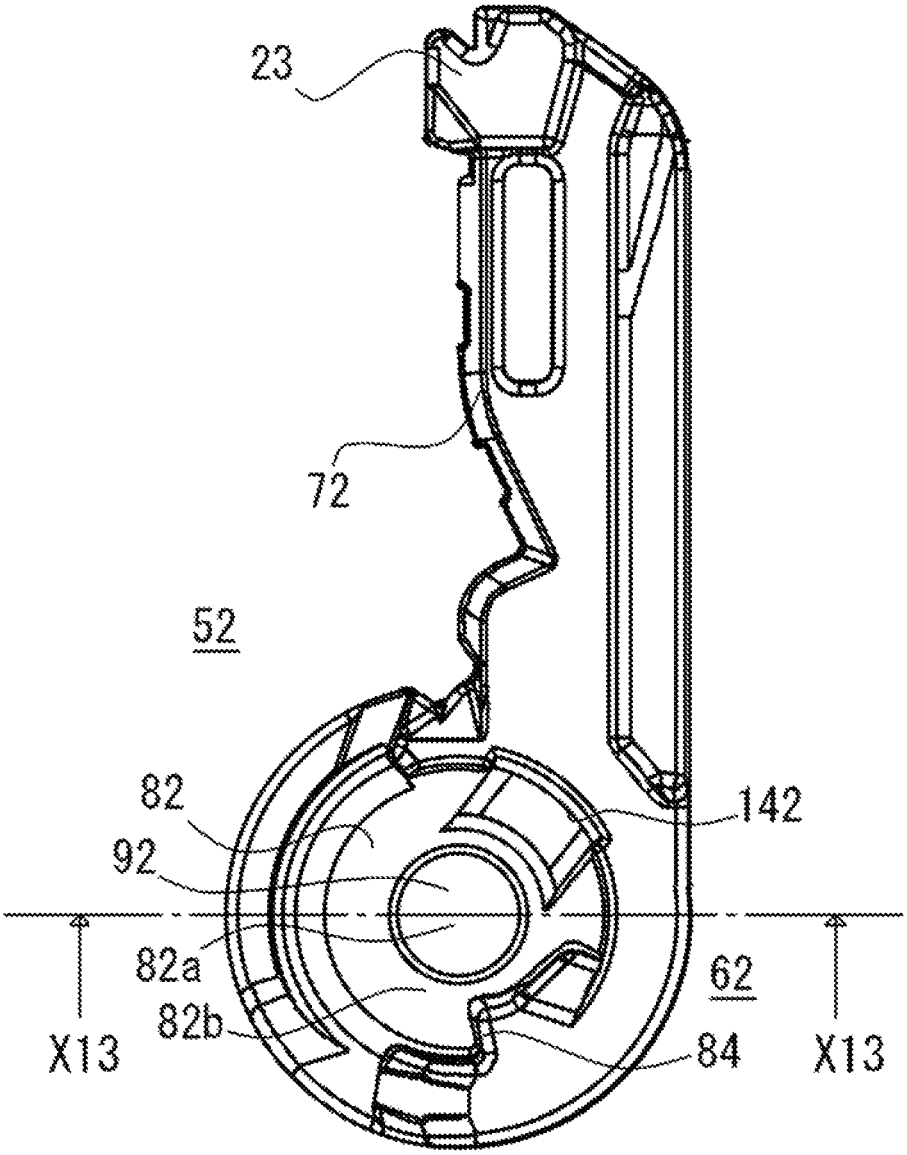

[Fig. 13]
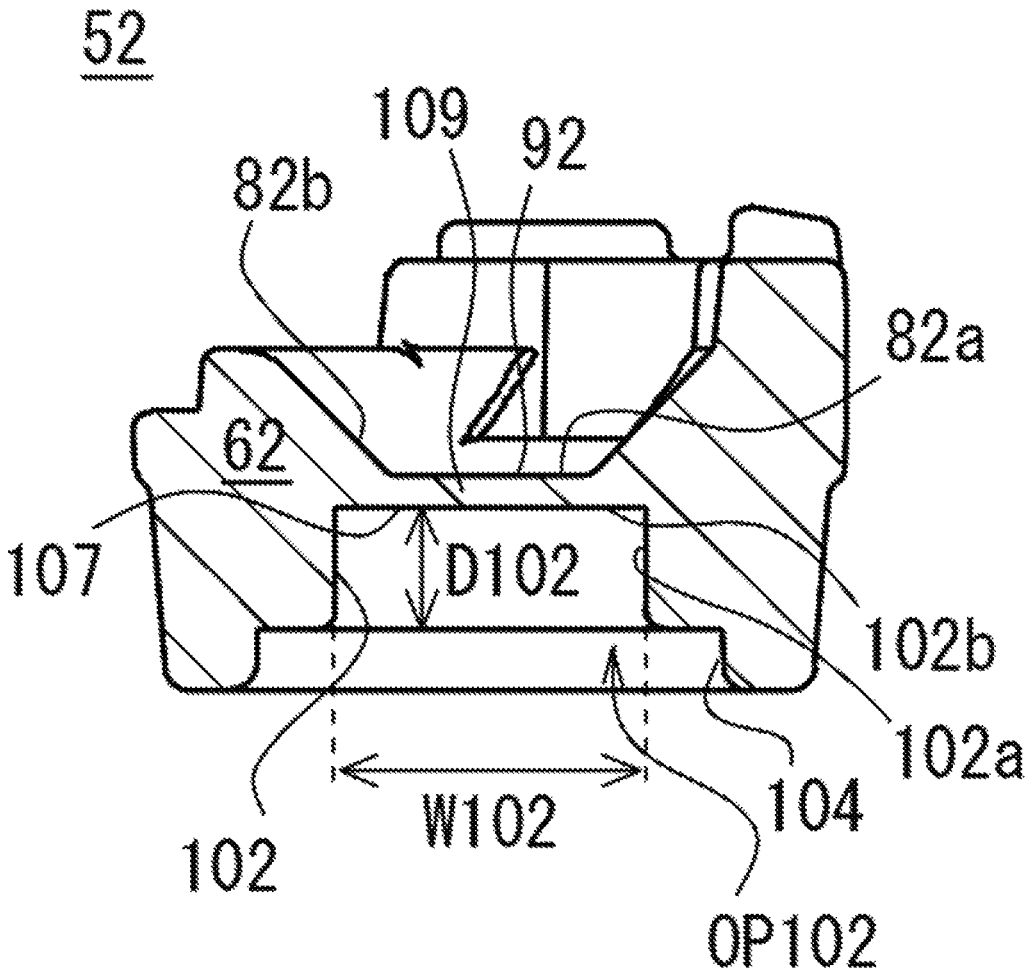

[Fig. 14]
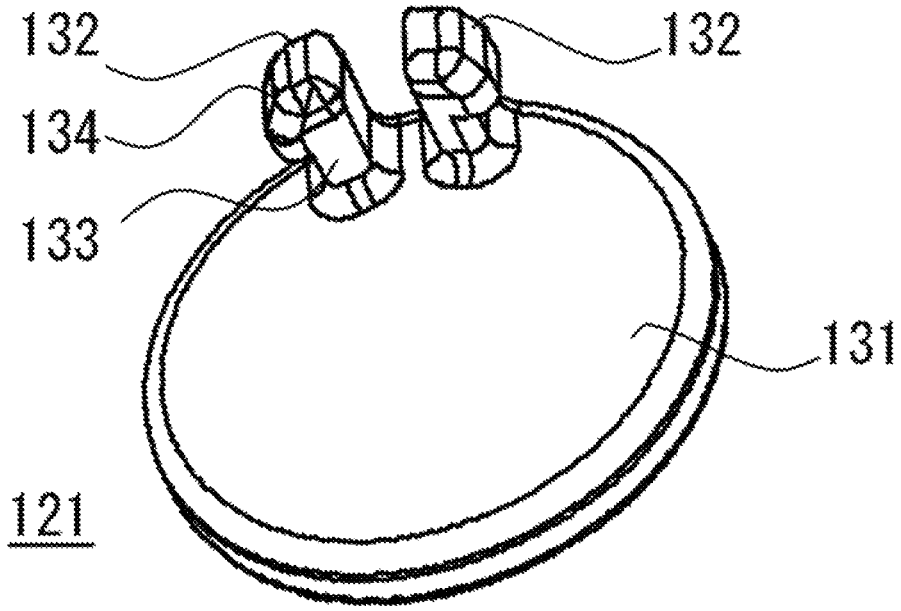

[Fig. 15]
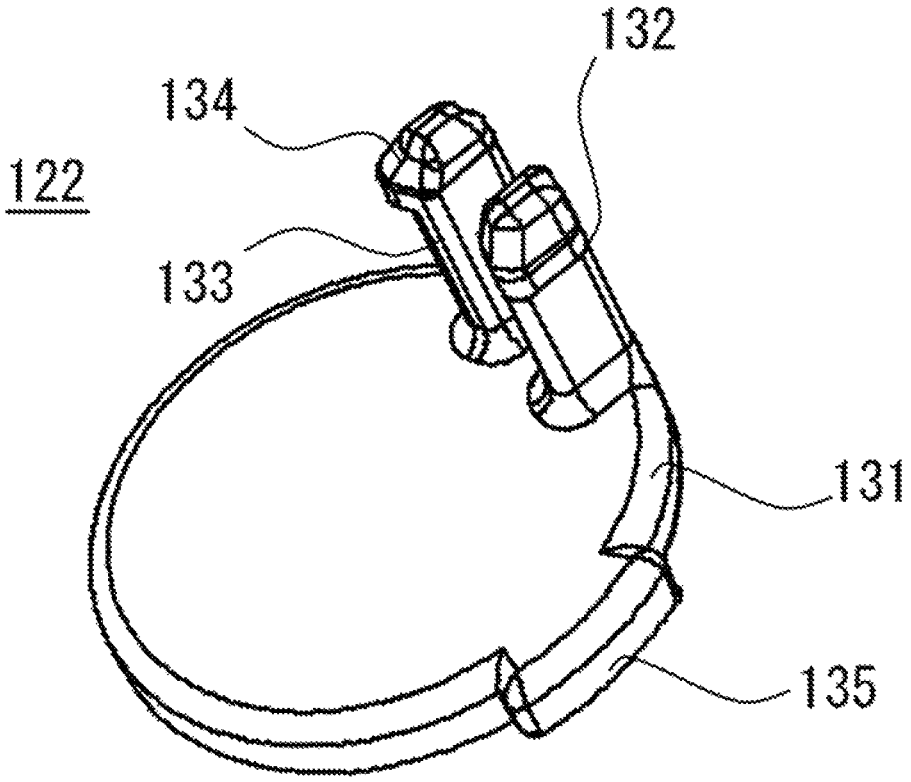

[Fig. 16]
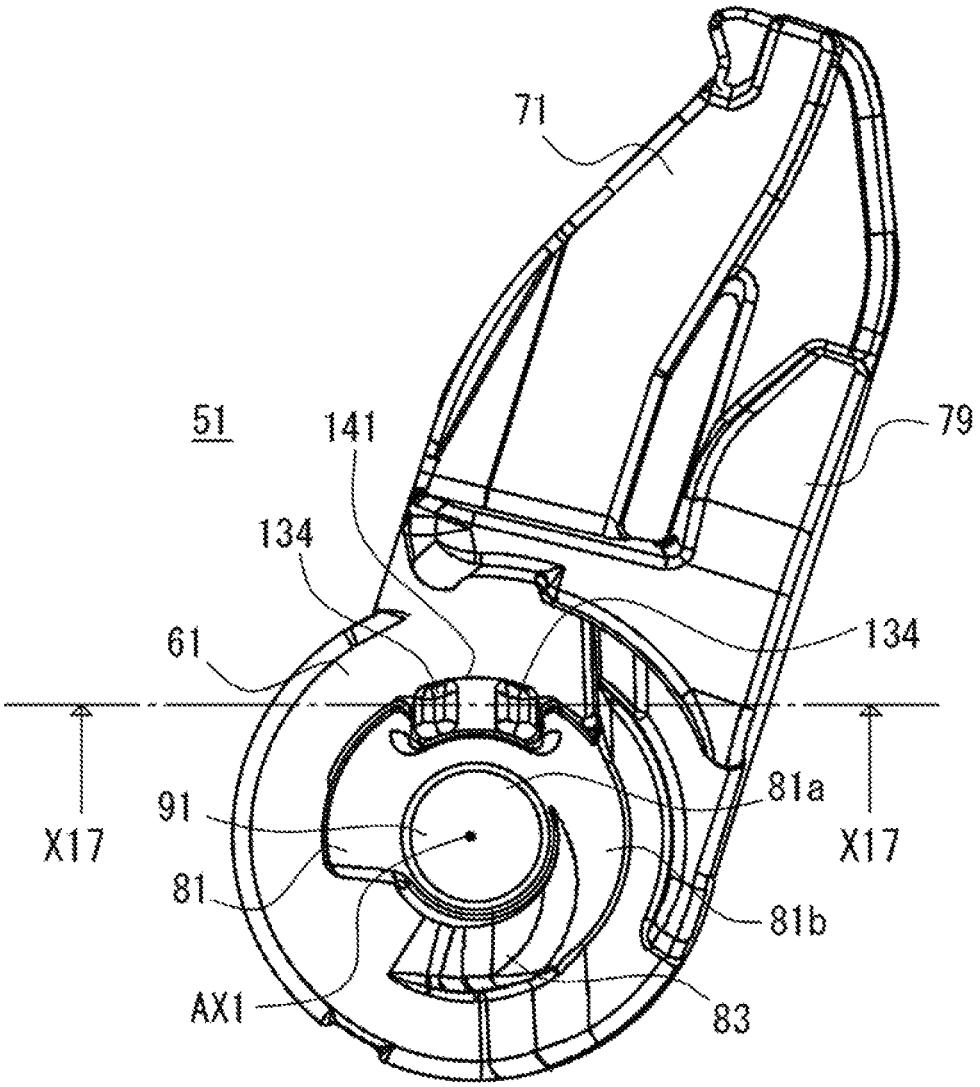

[Fig. 17]
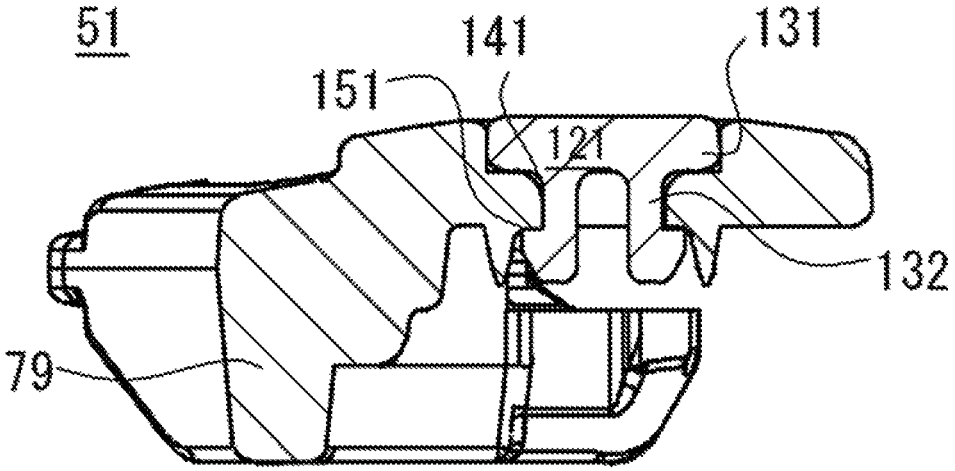

[Fig. 18]
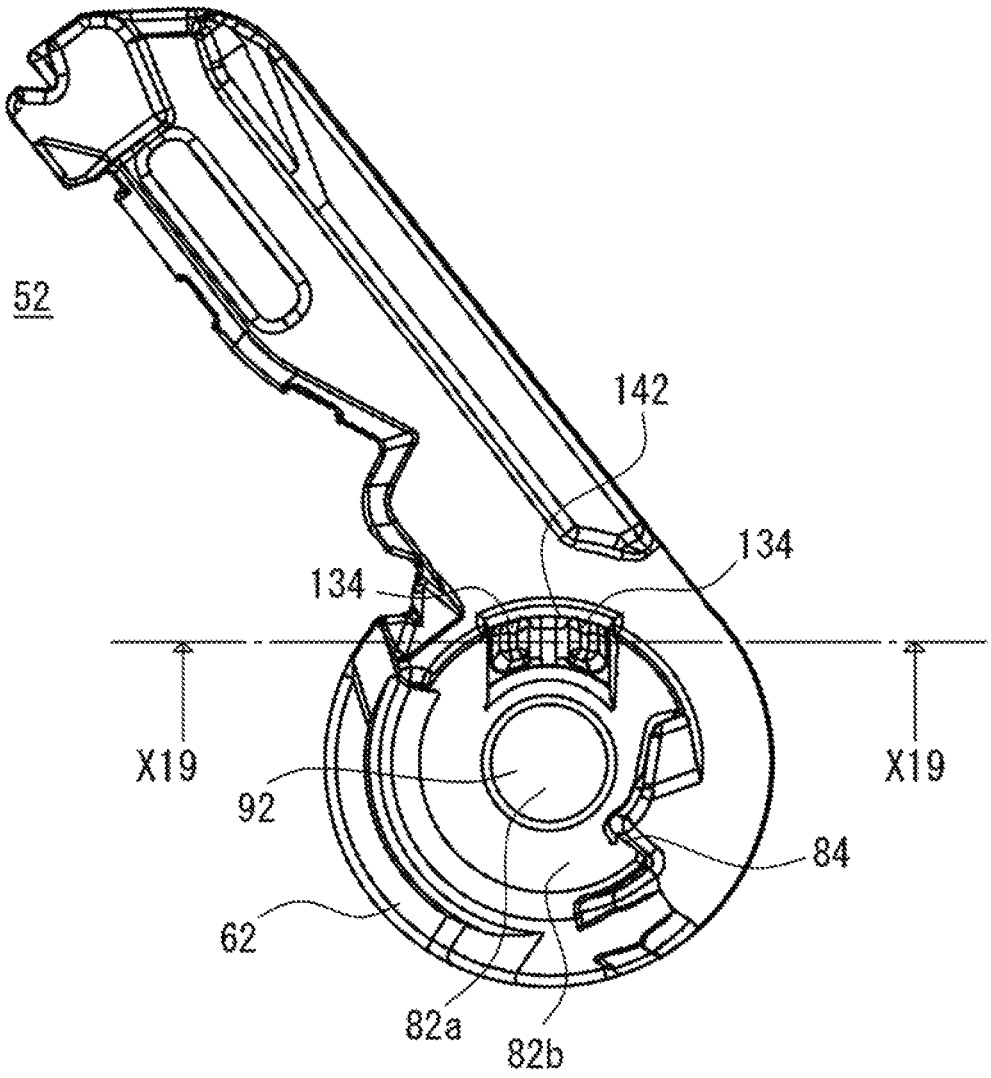

[Fig. 19]
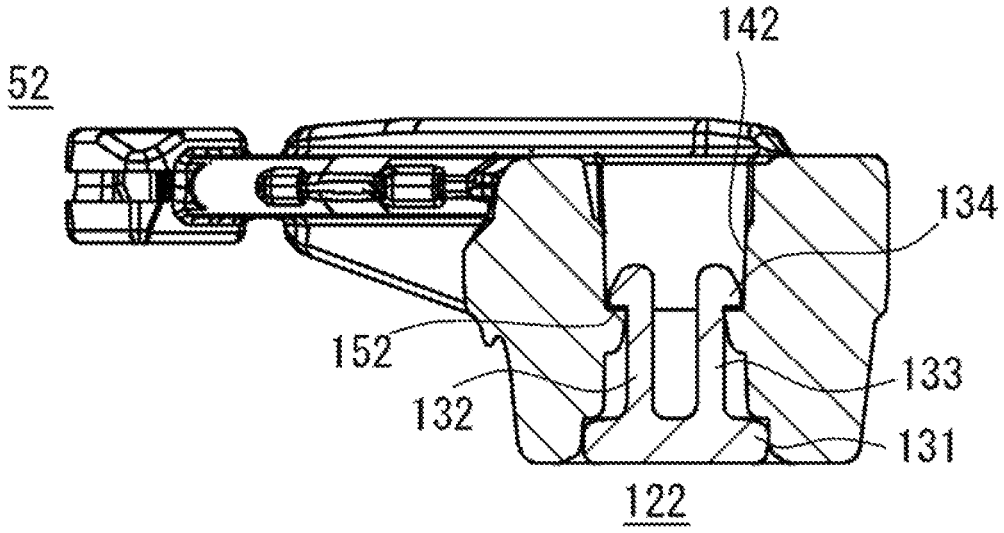
[Fig. 20]
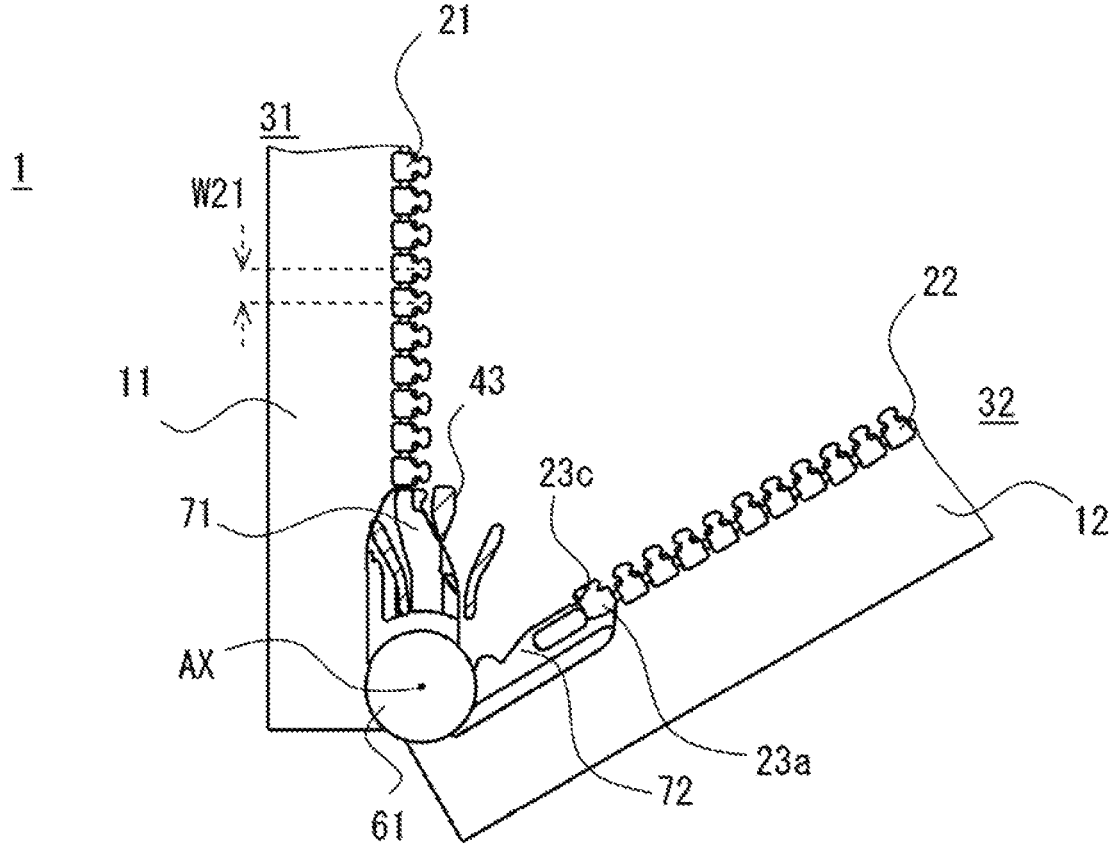

[Fig. 21]
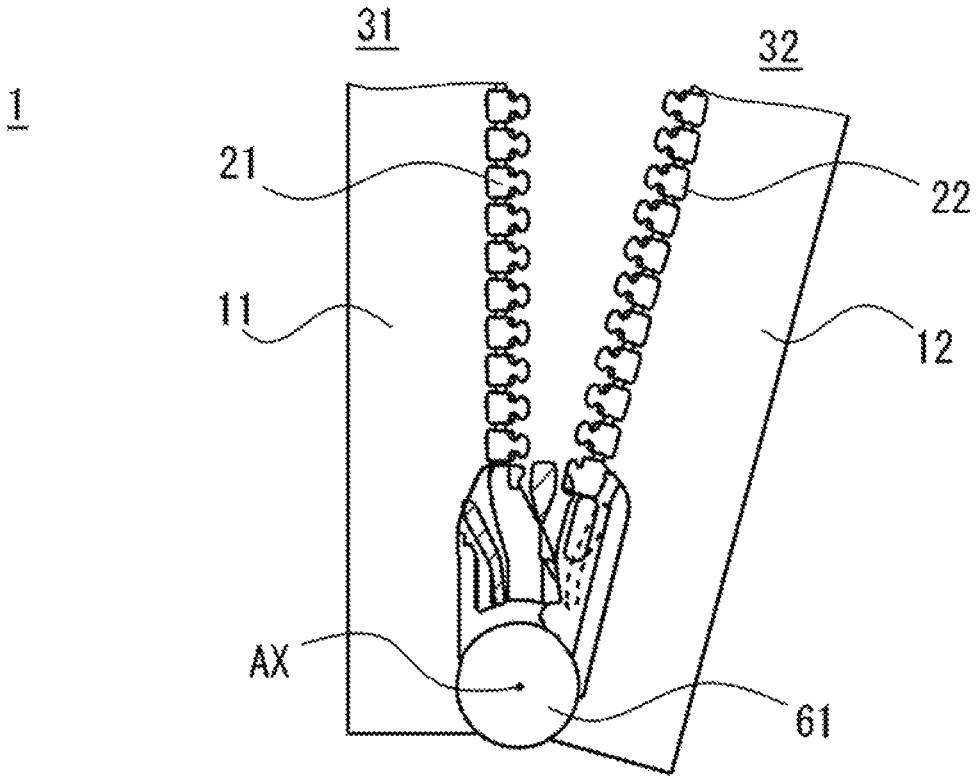

[Fig. 22]
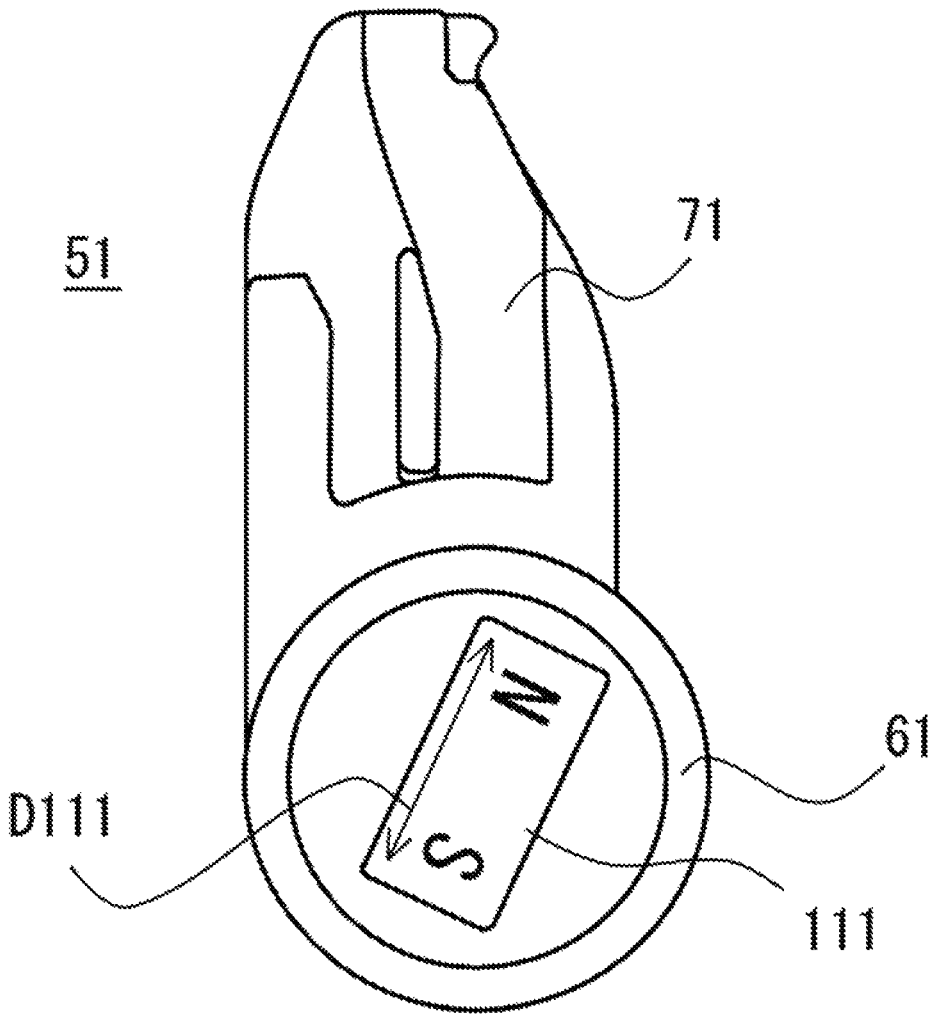

[Fig. 23]
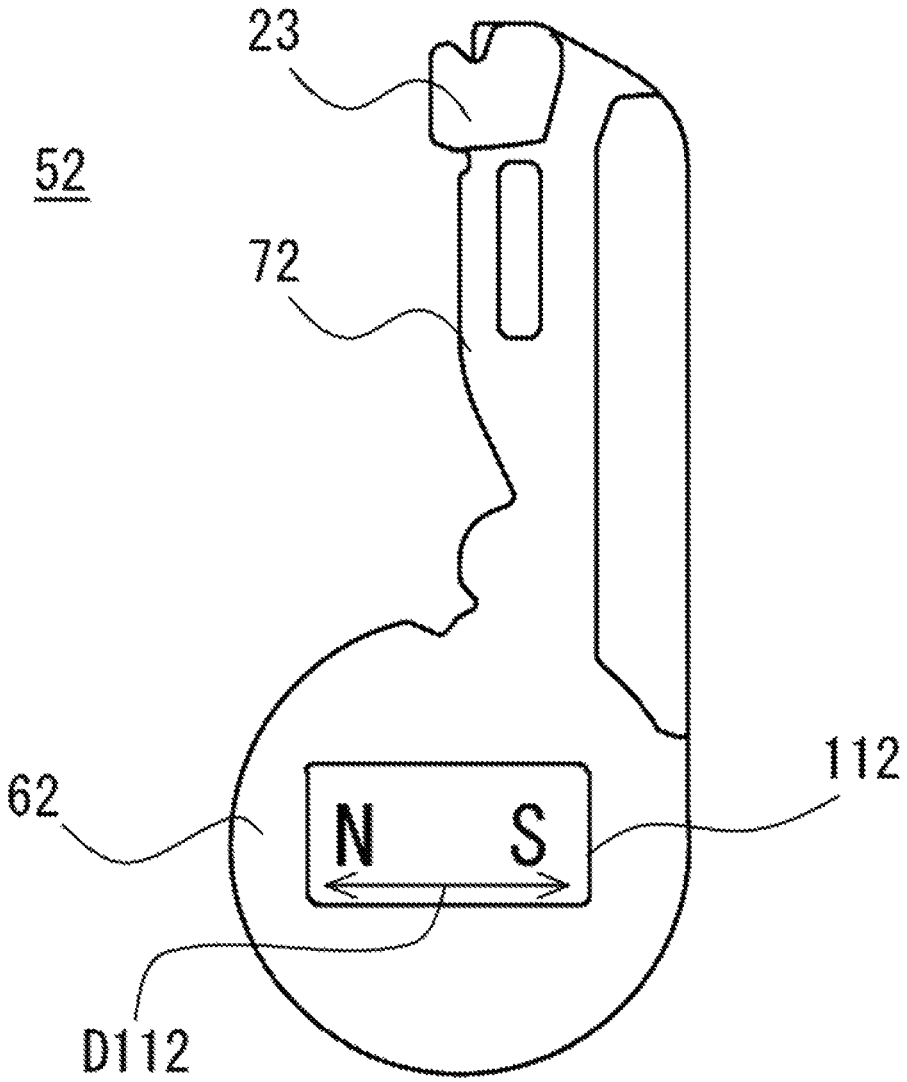

[Fig. 24]
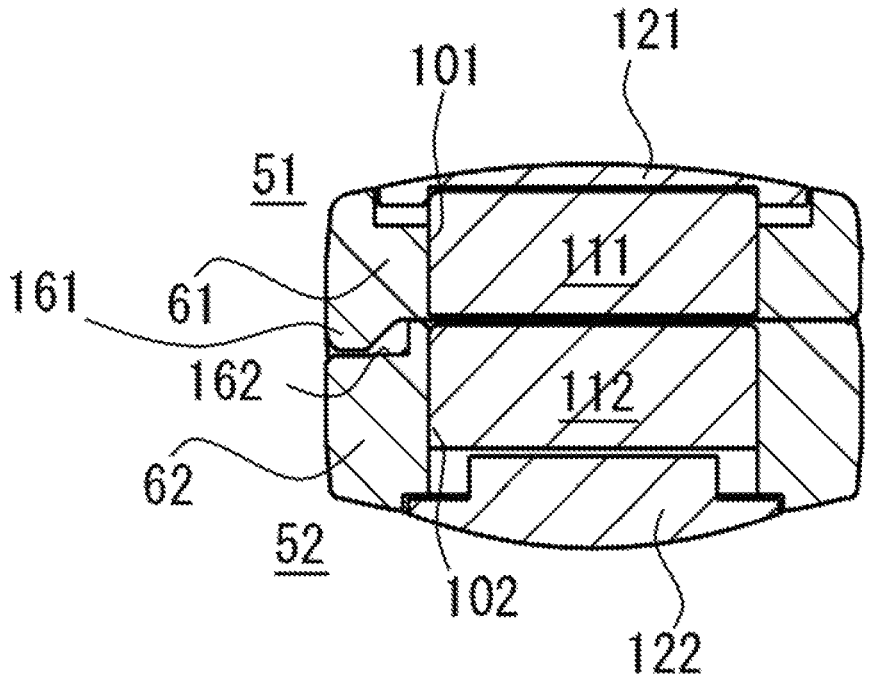

[Fig. 25]
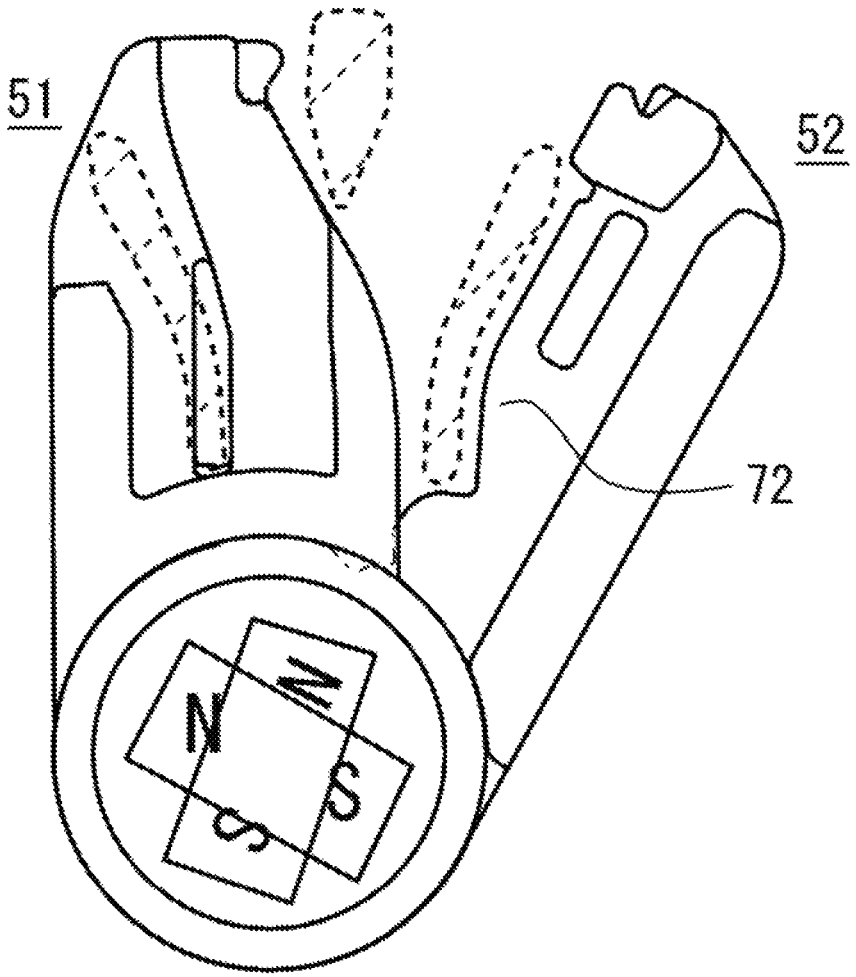

[Fig. 26]
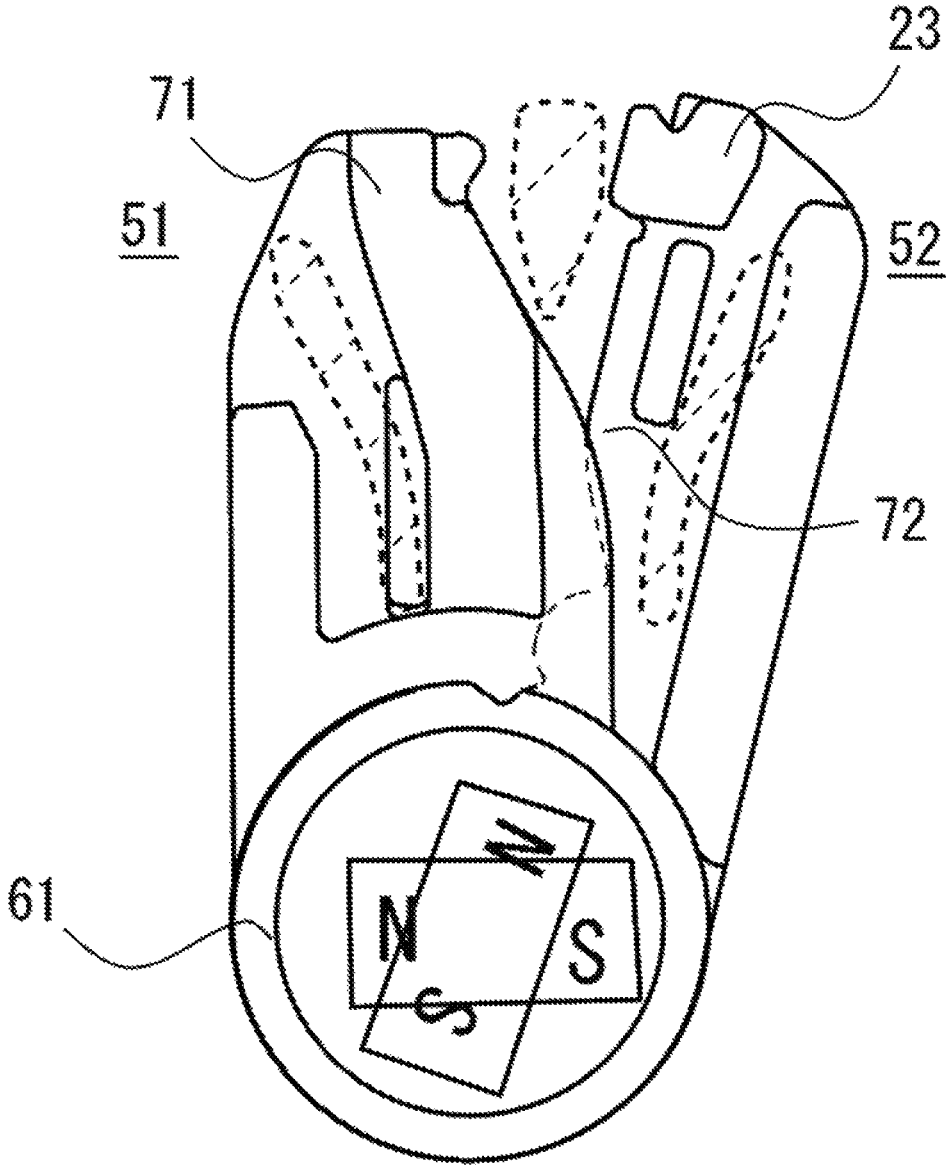

[Fig. 27]
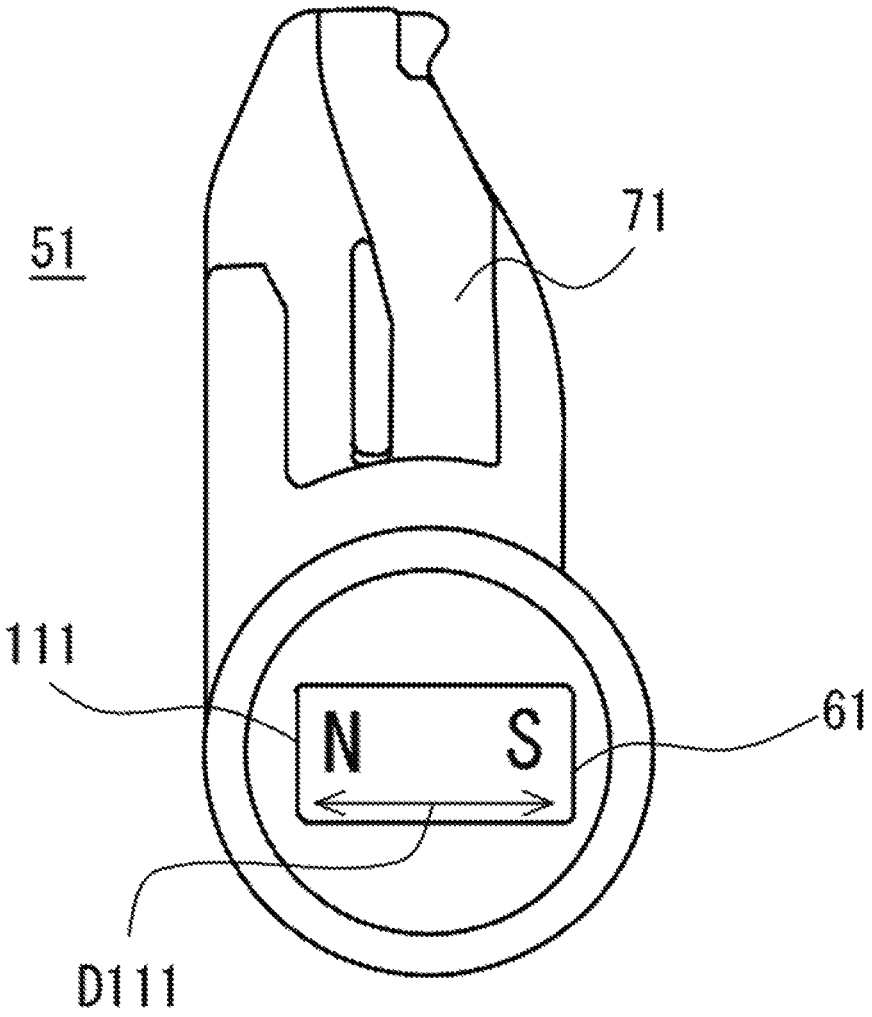

[Fig. 28]
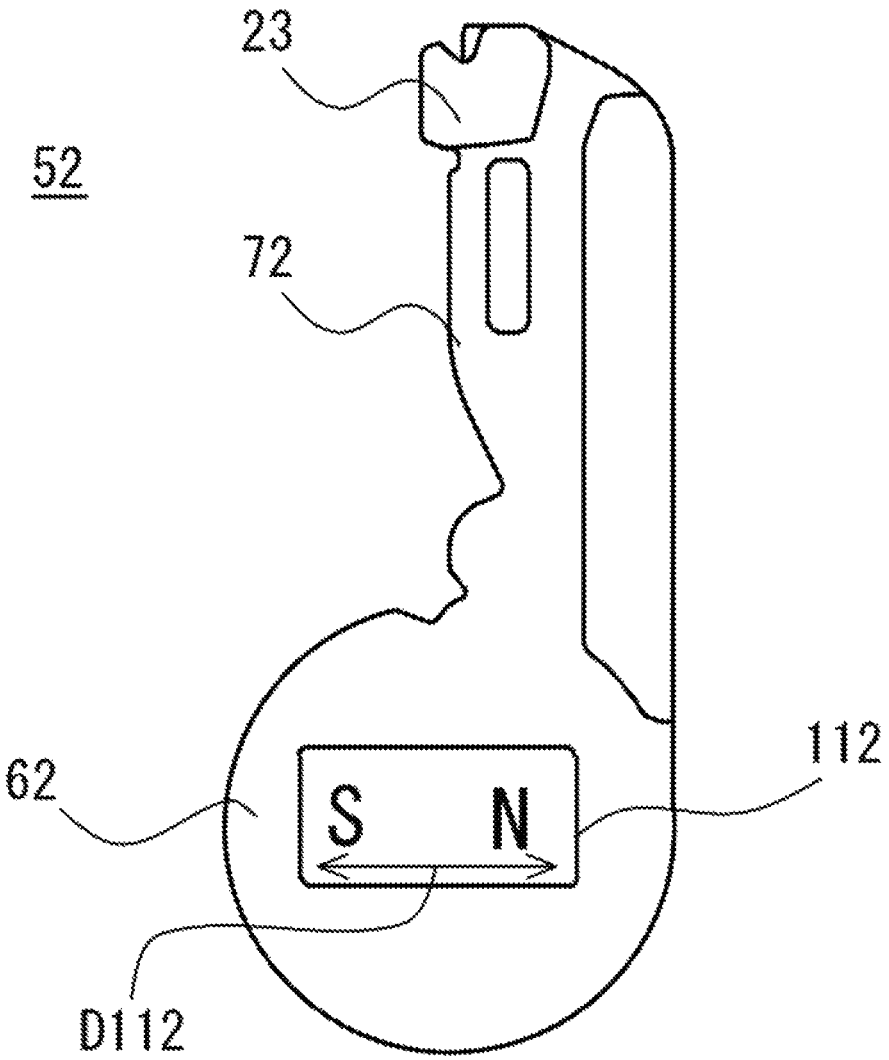

[Fig. 29]
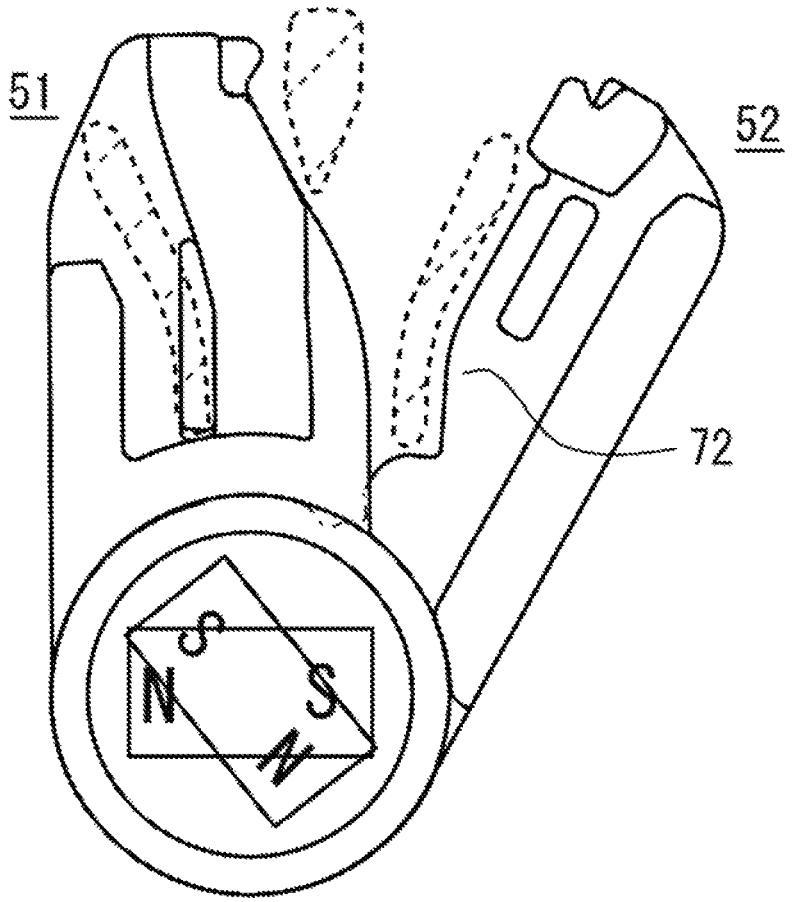

[Fig. 30]
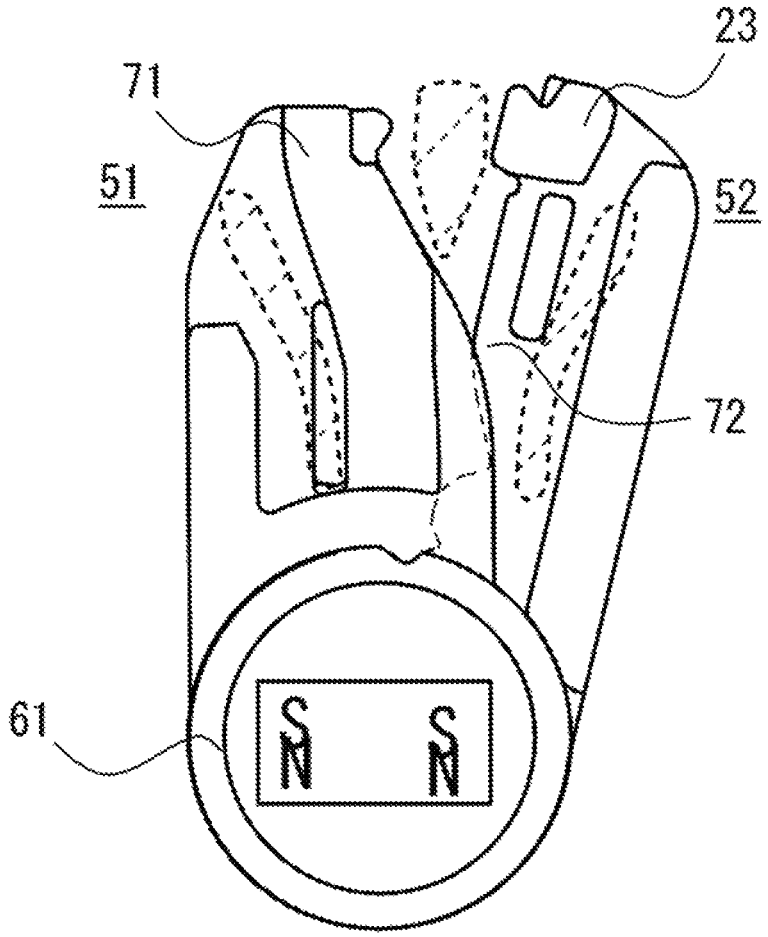

STOPPER AND SLIDE FASTENER COMPRISING SAME

CROSS-REFERENCE TO RELATED APPLICATIONS

This application is a U.S. National Stage entry of PCT Application No: PCT/JP2018/009575 filed Mar. 12, 2018, the contents of which are incorporated herein by reference.

TECHNICAL FIELD

The present disclosure is related to a stop member and a slide fastener including the same.

BACKGROUND ART

Patent literatures 1 and 2 disclose a separable stop for slide fastener with magnets embedded therein. Patent literature 1 discloses a support member 7 provided with a groove portion 15, and an insertion member 8 having a protruded portion 20 to be inserted into the groove portion 15. The groove portion 15 is provided with a magnet or magnetic body. The protruded portion 20 is provided with a magnet or magnetic body therein. The protruded portion 20 and the groove portion 15 are magnetically attracted each another, and the protruded portion 20 is automatically inserted into the groove portion 15 (See para. 0037 of Patent literature 1).

Patent literature 2 discloses a method of attaching a magnet shown in its FIGS. 5 and 6.

CITATION LIST

Patent Literature

[Patent literature 1] Japanese Utility-Model Registration No. 3,170,902

[Patent literature 2] Japanese Patent No. 4,152,216

SUMMARY

Technical Problem

The present inventors have newly identified a technical problem that, in the case of Patent literature 1 or 2, it may take time for inserting an insertion plate of the insertion member into a space between top and bottom flanges of slider.

Solution to Problem

Stop member according to an aspect of the present disclosure includes: a first member including a first insert to be inserted into a slider via a rear mouth of the slider, and a first base positioned rearward of the first insert; and a second member including a second insert to be inserted into the slider via a slit extending between the rear mouth and a front mouth of the slider, and a second base to be overlaid onto the first base. The first and second bases are configured to effect magnetic attraction and/or repulsion between the first and second bases, when the first and second bases are overlaid. The second base rotates relative to the first base in accordance with the magnetic attraction and/or repulsion to allow the second insert to pivot toward the slit. In some embodiments, the second base starts to rotate relative to the first base in accordance with magnetic attraction between the first and second bases. In some embodiments, the second base starts to rotate relative to the first base in accordance with magnetic repulsion between the first and second bases.

In some embodiments, the first and second bases are configured to effect magnetic attraction between the first and second bases when the first and second bases are overlaid. The second base rotates relative to the first base in a process of magnetic attachment of the first and second bases in accordance with the magnetic attraction.

In some embodiments, in accordance with the magnetic attraction, the second base moves closer to the first base in an axial direction of a rotational axis regarding the pivoting of the second insert and accordingly, the second insert pivots about the rotational axis.

In some embodiments, at least one of the first and second bases is provided with a permanent magnet.

In some embodiments, the permanent magnet has first and second poles arranged along a rotational axis regarding the pivoting of the second insert.

In some embodiments, the first and second bases are configured to effect magnetic repulsion when the first and second bases are overlaid, and the second base rotates relative to the first base in accordance with the magnetic repulsion.

In some embodiments, the first and second bases are respectively provided with first and second permanent magnets.

In some embodiments, each of the first and second permanent magnets has first and second poles arranged in a plane crossing or orthogonal to a rotational axis AX regarding the pivoting of the second insert.

In some embodiments, the first and second bases are engageable in a rotatable manner.

In some embodiments, the permanent magnet is housed in a housing of the first or second base.

In some embodiments, one of the first and second bases includes a sloped surface that extends about a rotational axis regarding the pivoting of the second insert and the other one of the first and second bases includes a sliding portion that slides on the sloped surface.

In some embodiments, one of the first base and the second base is provided with an axial portion and the other one of the first base and the second base is provided with a receiving portion that receives the axial portion.

In some embodiments, the first base is provided with the axial portion, the first base has a first housing for housing a first permanent magnet, and the first housing has a bottom positioned in the proximity of an end of the axial portion.

In some embodiments, the second base is provided with the receiving portion, the second base has a second housing for housing a second permanent magnet, and the second housing has a bottom positioned in the proximity of a bottom of the receiving portion.

A stop member according to an aspect of the present disclosure includes: a first member including a first insert to be inserted into a slider via a rear mouth of the slider and a first base positioned rearward of the first insert; and a second member including a second insert to be inserted into the slider via a slit extending between the rear mouth and a front mouth of the slider and a second base to be overlaid onto the first base. The first and second bases are configured to effect magnetic attraction and/or repulsion between the first and second bases when the first and second bases are overlaid. One of the first and second bases includes a sloped surface that extends about a rotational axis AX regarding the pivoting of the second insert and the other one of the first and second bases includes a sliding portion that slides on the sloped surface.

In some embodiments, the sloped surface is provided to convert displacement of the second base in an axial direction of the rotational axis to displacement of the second base about the rotational axis.

Slide fastener according to an aspect of the present disclosure has the above-described stop member.

Advantageous Effects of Invention

According to an aspect of the present disclosure, stop member may be provided with improved operability.

BRIEF DESCRIPTION OF DRAWINGS

FIG. 1 is a schematic elevational view of a rear end of a slide fastener provided with a stop member according to an aspect of the present disclosure. First and second fastener stringers are closed, and illustration of a slider positioned frontward of the stop member of the slide fastener is omitted.

FIG. 2 is a schematic perspective view of a non-limiting exemplary slider in a slide fastener according to an aspect of the present disclosure.

FIG. 3 is a schematic side view of a non-limiting exemplary slider in a slide fastener according to an aspect of the present disclosure.

FIG. 4 is schematic perspective view of a first member according to an aspect of the present disclosure.

FIG. 5 is a schematic perspective view of a first member according to an aspect of the present disclosure, illustrating a structure of the first member at the opposite side compared with FIG. 4.

FIG. 6 is a schematic perspective view of a first member according to an aspect of the present disclosure with the first member viewed obliquely from another point compared with FIG. 5.

FIG. 7 is a schematic perspective view of a second member according to an aspect of the present disclosure.

FIG. 8 is a schematic perspective view of a second member according to an aspect of the present disclosure, illustrating a structure of the second member at the opposite side compared with FIG. 7.

FIG. 9 is a schematic cross-sectional view of a stop member taken along a chain line X9-X9 in FIG. 1.

FIG. 10 is a schematic bottom view of a first member without illustration of first cover.

FIG. 11 is a schematic cross-sectional view of a first member taken along a chain line X11-X11 in FIG. 10, illustration of first permanent magnet and first cover are omitted.

FIG. 12 is a schematic top view of a second member, illustration of second cover is omitted.

FIG. 13 is a schematic cross-sectional view of a second member taken along a chain line X13-X13 in FIG. 12, illustration of second permanent magnet and second cover are omitted.

FIG. 14 is a schematic perspective view of a first cover.

FIG. 15 is a schematic perspective view of a second cover.

FIG. 16 is a schematic bottom view of a first member in which a first cover is attached to a first base.

FIG. 17 is a schematic cross-sectional view of a first member taken along a chain line X17-X17 in FIG. 16 with a first cover attached to a first base.

FIG. 18 is a schematic top view of a second member with a second cover attached to a second base.

FIG. 19 is a schematic cross-sectional view of a second member taken along a chain line X19-X19 in FIG. 18 with a second cover attached to a second base.

FIG. 20 is a schematic view illustrating a process of magnetic attachment of the first and second bases in which a sliding portion slides down a sloped surface and a second insert of second member moves toward a slit of slider, and depicting a condition before the second insert enters into the slider via the slit of the slider.

FIG. 21 is a schematic view illustrating a process of magnetic attachment of the first and second bases in which a sliding portion slides down a sloped surface and a second insert of second member moves toward a slit of slider, depicting a condition after the second insert entered into the slider via the slit of the slider.

FIG. 22 is a schematic view of a first member having a first permanent magnet of bar magnet.

FIG. 23 is a schematic view of a second member having a second permanent magnet of bar magnet.

FIG. 24 is a schematic cross-sectional view illustrating an embodiment where a first permanent magnet housed in a first housing of the first base is covered by a first cover and a second permanent magnet housed in a second housing of second base is covered by a second cover.

FIG. 25 is a schematic view illustrating that a first base of first member and a second base of second member are overlaid. Second insert moves toward a slit of slider in accordance with magnetic repulsion effected between first and second permanent magnets of first and second bases.

FIG. 26 is a schematic view illustrating that a second insert has been inserted in a slider via a slit of the slider in accordance with magnetic repulsion effected between first and second permanent magnets of first and second bases.

FIG. 27 is a schematic view of a first member having a first permanent magnet of bar magnet.

FIG. 28 is a schematic view of a second member having a second permanent magnet of bar magnet.

FIG. 29 is a schematic view illustrating that first and second bases of first and second members are overlaid. Second insert moves toward a slit of slider in accordance with magnetic attraction effected between first and second permanent magnets of first and second bases.

FIG. 30 is a schematic view illustrating that a second insert has been inserted in a slider via a slit of slider in accordance with magnetic attraction effected between first and second permanent magnets of first and second bases.

DESCRIPTION OF EMBODIMENTS

Hereinafter, embodiments of the present invention will be described with reference to FIGS. 1 to 30. A skilled person would be able to combine respective embodiments and/or respective features without requiring excess descriptions. Also, a skilled person would appreciate synergistic effects of such combinations. Overlapping descriptions among the exemplary embodiments would be basically omitted. Referenced drawings are mainly for describing inventions, and may possibly be simplified for the sake of convenience of illustration. Individual features may possibly be highlighted by an expression "in some embodiments". Individual features will be understood as universal feature which is not only effective to disclosed stop members but also effective to undisclosed stop members.

FIG. 1 is a schematic elevational view of a rear end of a slide fastener 1 provided with a stop member 50 according to an aspect of the present disclosure. First and second fastener stringers 31,32 are closed, and illustration of slider 40 (See FIGS. 2 and 3) positioned frontward of the stop member 50 of the slide fastener 1 is omitted. FIG. 2 is a schematic perspective view of a non-limiting exemplary slider 40 included in the slide fastener 1. FIG. 3 is a schematic side view of a non-limiting exemplary slider 40 included in the slide fastener 1.

Slide fastener 1 has first and second fastener stringers 31,32 and a slider 40 for opening and closing the first and second fastener stringers 31,32. The first fastener stringer 31 has a first fastener tape 11 and first fastener elements 21 provided on the side-edge, extending in the lengthwise direction, of the first fastener tape 11. The second fastener stringer 32 has a second fastener tape 12, and second fastener elements 22 provided on a side-edge, extending in the lengthwise direction, of the second fastener tape 12.

Fastener tape 11,12 may be a fabric such as woven fabric or knitted fabric or combination thereof. The fastener tape 11,12 has a pair of tape surfaces which define a thickness of the fastener tape. The fastener element 21,22 may be a resin element, metal element, coil element or other types of element. The side-edge of the first fastener tape 11 with the first fastener element 21 and the side-edge of the second fastener tape 12 with the second fastener element 22 are arranged to face one another, and thus may be referred to as opposed side-edges.

Frontward movement of slider 40 closes the first and second fastener stringers 31,32. Rearward movement of slider 40 opens the first and second fastener stringers 31,32. In the present specification, "Front-and-Rear direction" is determined based on a direction of movement of slider 40. The first and second fastener stringers 31,32 are arranged in Left-and-Right direction that is orthogonal to the Front-and-Rear direction. The first and second fastener stringers 31,32 can be thus referred to as left and right fastener stringers. This holds true for the fastener tapes 11,12 and the fastener elements 21,22.

Left-and-Right direction is a direction orthogonal to the Front-and-Rear direction and parallel to a tape surface of respective fastener tapes 11,12. Up-and-Down direction is orthogonal to Front-and-Rear direction and Left-and-Right direction. Up-and-Down direction matches a direction an interconnecting post 43 (described below) of the slider 40 extends. Redefining the Font-and-Rear direction, Left-and-Right direction, and Up-and-Down direction would be possible based on other descriptions in the present specification.

As shown in FIGS. 2 and 3, the slider 40 has a top wing 41, a bottom wing 42, and an interconnecting post 43 that interconnects the top wing 41 and the bottom wing 42. Paired left and right front mouths 44 are arranged to sandwich the interconnecting post 43. Rear mouth 45 is arranged at the opposite side relative to the front mouth 44 in the front-and-rear direction. Left slit (or tape-passage) 46, allowing the first fastener tape 11 to move there-though, extends between the left-side front mouth 44 and the rear mouth 45. Right slit 46, allowing the second fastener tape 12 to move there-through, extends between the right-side front mouth 44 and the rear mouth 45.

The slider 40 has Y-shaped element-passage bifurcated by the interconnecting post 43 between the top wing 41 and the bottom wing 42. First fastener elements 21 enter in and go out from the slider 40 via the left-side front mouth 44. Second fastener elements 22 enter in and go out from the slider 40 via the right-side front mouth 44. Engaged first and second fastener elements 21,22 enter in and go out from the slider 40 via the rear mouth 45.

Top wing 41 of the slider 40 includes a top wing plate 41*a* and paired top flanges 41*b* protruded downward at the left and right side-edges of the top wing plate 41*a*. Bottom wing 42 includes a bottom wing plate 42*a* and paired bottom flanges 42*b* protruded upward at the left and right side-edges of the bottom wing plate 42*a*. In some cases, one of the top and bottom flanges 41*b* and 42*b* is omitted. The top wing plate 41*a* and the bottom wing plate 42*a* may be arranged in a plane orthogonal to Up-and-Down direction along which the interconnecting post 43 extends. Optionally, the slider 40 has a pull-attachment column 48 and a pull tab 49 attached to the top wing plate 41*a* via the pull-attachment column 48. Optionally, the slider 40 has a locking pawl 47 to be operated by the pull tab 49. Note that, the slider 40 may be made of metal, resin or other material.

Slide fastener 1 has a stop member 50 additionally to the above-described first and second fastener stringers 31,32. The stop member 50 defines a stop position for the slider 40. The stop member 50 of the present disclosure has first and second members 51 and 52 which are separable. Separation of the first and second members 51 and 52 allows separation of the first and second fastener stringers 31,32. Therefore, the stop member 50 may be referred to as a separable stop. The first member 51 is secured to the first fastener tape 11 and positioned rearward of the first fastener element 21. The second member 52 is secured to the second fastener tape 12 and positioned rearward of the second fastener element 22. The first or second member 51,52 may be arranged to be slightly protruded rearward from the terminal end 11*e*, 12*e* of the first or second fastener tape 11,12, not necessarily limited to this though. The stop member 50 is provided at the terminal of the fastener stringer 31,32 or of the fastener tape 11,12 or of the fastener elements 21,22 and thus may be referred to as a terminal member. Note that, each of the first and second members 51 and 52 may be made of resin, metal or other material.

FIG. 4 is schematic perspective view of the first member 51. FIG. 5 is a schematic perspective view of the first member 51, illustrating a structure of the first member at the opposite side compared with FIG. 4. FIG. 6 is a schematic perspective view of the first member 51 which is viewed obliquely from a different point compared with FIG. 5. FIG. 7 is a schematic perspective view of the second member 52. FIG. 8 is a schematic perspective view of the second member 52, illustrating a structure of the second member 52 at the opposite side compared with FIG. 7. FIG. 9 is a schematic cross-sectional view of the stop member taken along a chain line X9-X9 in FIG. 1.

As would be understood by referring to FIGS. 1 and 4-8, the first member 51 has a first insert 71 to be inserted into the slider 40 via the rear mouth 45 of the slider 40 of the slide fastener 1; and a first base 61 positioned rearward of the first insert 71. The second member 52 includes a second insert 72 to be inserted into the slider 40 via the slit 46 extending between the rear mouth 45 and the front mouth 44 of the slider 40, and a second base 62 to be overlaid onto the first base 61.

As would be well understood from FIG. 9 and the following descriptions, in the present embodiment, the first and second bases 61,62 are configured to effect magnetic attraction and/or repulsion (in the case of FIG. 9, magnetic attraction) between the first and second bases 61,62 when the first and second bases 61,62 are overlaid. The second base 62 rotates relative to the first base 61 in accordance with the magnetic attraction and/or repulsion to allow the second insert 72 to pivot toward the slit 46. Accordingly, the stop member 50 with improved operability can be provided.

The first insert 71 extends along the Front-and-Rear direction between the first base 61 and the first fastener elements 21. The second insert 72 extends along the Front-and-Rear direction between the second base 62 and the second fastener elements 22. The first insert 71 has a groove 73 into which the second insert 72 is inserted. The groove 73 extends in the Front-and-Rear direction and is opening at front, rear and right sides. The groove 73 receives the second insert 72 which has entered into the slider 40 via the right-side slit 46 of the slider 40 while the first insert 71 has been inserted into the slider 40. The second insert 72 is inserted into the groove 73 of the first insert 71 so that upward-and-downward displacement of the second insert 72 is restricted.

The first member 51 may be configured to facilitate to keep the slider 40 stationary on the first member 51. It is facilitated that the second insert 72 can enter into the slider 40 via the right-side slit 46 of the slider 40 while the first insert 71 has been inserted into the slider 40.

Additionally to the first insert 71, the first member 51 may have one or any combination of a thin plate 74, a guide 75, and a stopping wall 76. Thin plate 74 is arranged adjacent to the first insert 71 in the left-and-right direction. Thin plate 74 has a thickness that enables its insertion into the slit 46 of the slider 40. Guide 75 is projected from the thin plate 74 in Up-and-Down direction and extends along the Front-and-Rear direction. Embodiments are envisioned where the guide 75 is protruded from the thin plate 74 upward only or downward only. Groove 77 is formed between the first insert 71 and the guide 75, and a flange portion of the slider 40 is inserted into the groove 77. Note that likewise the guide 75, the first insert 71 is protruded from the thin plate 74 in Up-and-down direction. The stopping wall 76 extends in Left-and-Right direction and is coupled to the first insert 71, the thin plate 74, and the guide 75. The stopping wall 76 defines a stop position for the slider 40.

The first base 61 is positioned rearward of the first insert 71, and is directly or indirectly coupled to the first insert 71. Indirect coupling of the first base 61 with the first insert 71 indicates that the first base 61 is coupled with the first insert 71 via another or other structural portion(s) such as the stopping wall 76. The first base 61 has a flat plate 63, an axial portion 81, and a sloped surface 83. The axial portion 81 is arranged in and protruded downward from the bottom surface the flat plate 63. The axial portion 81 has a portion with a diameter reduced toward the end 91. The axial portion 81 has an end surface 81*a* in its end 91, and an outer peripheral surface 81*b* in the outer periphery of the end surface 81*a*. Flattened end surface 81*a* reduces a stimulus otherwise given to a human skin by the axial portion 81. The sloped surface 83 extends about a rotational axis AX regarding the pivoting of the second insert 72. The sloped surface 83 extends in an arc about the rotational axis AX, but embodiments are envisioned where it extends across the entire circle about the rotational axis AX. The sloped surface 83 extends between the outer peripheral surface 81*b* of the axial portion 81 and the bottom surface of the flat plate 63. Particularly, in some cases, the sloped surface 83 is arranged to convert displacement of the second base 62 in the axial direction of the rotational axis AX to displacement of the second base 62 about the rotational axis AX.

The second insert 72 of the second member 52 includes a portion which is capable of entering into the slider 40 via the slit 46 of the slider 40. For example, the second insert 72 is a flat plate with a thickness enabling the passing via the slit 46 of the slider 40. The second insert 72 has a side-edge 72*a* that touches the top wing 41 or the bottom wing 42 of the slider 40. The side-edge 72*a* of the second insert 72 has a shape that matches a side part of the profile of the top or bottom wing 41 or 42 of the slider 40. The side-edge 72*a* of the second insert 72 has a recess 72*b* for avoiding interference with a corner 42*c* of the slider 40.

The second member 52 has a guide 85 and a third fastener element 23 additionally to the second insert 72. The guide 85 is protruded in both sides of upward and downward from the second insert 72, and extends in the Front-and-Rear direction. This guide 85 defines a passage for the slider 40. The third fastener element 23 is coupled to the front end of the second insert 72 and is positioned between the second insert 72 and the second fastener element 22. When the second insert 72 is inserted into the slider 40 via the slit 46 which extends between the rear mouth 45 and the front mouth 44 of the slider 40, the third fastener element 23 is positioned adjacent to and frontward of the front mouth 44 of the slider 40. Frontward movement of the slider 40 allows the third fastener element 23 to be inside the slider 40 and, in turn, be engaged with the first fastener element 21 inside the slider 40 (See FIG. 1).

The third fastener element 23 has a groove 24 and the first insert 71 has an insertion portion 25. The insertion portion 25 of the first insert 71 is inserted into the groove 24 of the third fastener element 23 (see FIG. 1), thus suppressing the front ends of the first and second members 51 52 from being separated in Up-and-Down direction.

The second base 62 has a receiving portion 82 that receives the axial portion 81 of the first base 61, and a sliding portion 84 that slides on the sloped surface 83 provided in the first base 61. The receiving portion 82 has a bottom surface 82*a* that is opposed to the end surface 81*a* of the axial portion 81, and an outer peripheral surface 82*b* that is opposed to the outer peripheral surface 81*b* of the axial portion 81. The bottom surface 82*a* is a substantially flat surface but should not be limited to this. The outer peripheral surface 82*b* is a slant surface that slants obliquely relative to the bottom surface 82*a*. The sliding portion 84 is arranged to protrude into the internal space of the receiving portion 82. When the first base 61 and the second base 62 are overlaid, the sliding portion 84 is protruded radially inward of the rotational axis AX regarding the pivoting of the second insert 72. The sliding portion 84 has a projected part 84*a*. When the sliding portion 84 finishes in sliding across the sloped surface 83, the projected part 84*a* of the sliding portion 84 is inserted into a recess 81*c* of the axial portion 81 (See FIG. 6).

Note that embodiments are obviously envisioned where the second base 62 is provided with the axial portion 81 and the first base 61 is provided with the receiving portion 82. Embodiments are naturally envisioned where the second base 62 is provided with the sloped surface 83 and the first base 61 is provided with the sliding portion 84. Note that, the axial portion 81 and the receiving portion 82 are provided for a purpose of positioning when stacking the first and second bases 61 and 62 and/or for a purpose of enhancing a rotational stability of the first and second bases 61 and 62.

The first and second bases 61,62 are configured to effect magnetic attraction and/or repulsion (magnetic attraction in the case of FIG. 9) between the first and second bases 61,62 when the first and second bases 61,62 are overlaid. Furthermore, the second base 62 is rotatable relative to the first base 61 in accordance with the magnetic attraction and/or repulsion to allow the second insert 72 to pivot towards the slit 46. Accordingly, the stop member 50 with improved operability can be provided.

There are various ways in terms of how the above-described magnetic attraction and/or repulsion is effected. In some cases, the magnetic attraction is effected based on the use of at least one permanent magnet. In some cases, the magnetic repulsion is effected based on the use of permanent magnets respectively provided in the first and second bases 61,62.

Specifically, the following cases are envisaged: (i) the first base 61 has one or more permanent magnets, and the second base 62 has one or more magnetic bodies; (ii) the first base 61 has one or more magnetic bodies, and the second base 62 has one or more permanent magnets; and (iii) the first base 61 has one or more permanent magnets, and the second base 62 has one or more permanent magnets. Use of the permanent magnet and the magnetic body can effect the magnetic attraction. Use of the permanent magnet and the permanent magnet can effect the magnetic attraction and/or repulsion. When the first base 61 and the second base 62 are overlaid, if a first pole (e.g. N-pole) of the permanent magnet in the first base 61 and a second pole (e.g. S-pole) of the permanent magnet in the second base 62 are arranged closely, the magnetic attraction would be effected between them. When the first base 61 and the second base 62 are overlaid, if a first pole (e.g. N-pole) of the permanent magnet in the first base 61 and a first pole (e.g. N-pole) of the permanent magnet in the second base 62 are arranged closely, the magnetic repulsion would be effected between them.

The permanent magnet has first and second poles as widely known. The first pole is one of N-pole and S-pole and the second pole is the other one of N-pole and S-pole. The magnetic body can be made of any material magnetically attachable to the permanent magnet and, for example, including one or more metals selected from Iron (Fe), Cobalt (Co), Nickel (Ni), and Gadolinium (Gd). Magnetic body can include stainless-steel such as martensite, ferrite, and austenite-ferrite. Note that the stainless-steel is an alloy and, in fact, includes Iron (Fe). The permanent magnet and magnetic body can take various shapes such as a bar, circular plate, and ring. Embodiments are envisioned where particulate permanent magnets and magnetic bodies are used.

The permanent magnet and/or magnetic body can be variously provided in the first base 61 and the second base 62. Embodiments are envisioned where the permanent magnet and/or magnetic body is embedded in the first base 61 through insert-molding or other methods. Embodiments are envisioned where the permanent magnet and/or magnetic body is fitted with or secured, by adhesive, to the first base 61. Embodiments are envisioned where the first base 61 is provided with a housing for hosing the permanent magnet and/or magnetic body. Similar embodiments are envisioned for the second base 62 either.

Embodiments are envisioned where the first member 51 (or the first base 61) or the second member 52 (or the second base 62) itself is made of magnetic material. For example, the first member 51 or the second member 52 is produced by casting of magnetic metal. Attachment of the first member 51 to the first fastener tape 11 can be achieved by any methods such as sewing and gluing. The same applies to attachment of the second member 52 to the second fastener tape 12. Note that, in typical cases, the first member 51 is fixed to the first fastener tape 11 as a result of insert-molding using a plastic/resin. Likewise, the second member 52 is fixed to the second fastener tape 12. In cases where the first member 51 (or the first base 61) or the second member 52 (or the second base 62) itself is made of magnetic material, the first base 61 or the second base 62 can additionally have a permanent magnet or magnetic body.

Referring to FIGS. 10-13, embodiments will be described where the first base 61 is provided with a first housing 101 for housing the first permanent magnet 111 and the second base 62 is provided with a second housing 102 for housing the second permanent magnet 112. Note that replacing one of the first and second permanent magnets 111, 112 with magnetic body can also be understandable. In other words, one can read the following descriptions with replacing one of the first and second permanent magnets 111, 112 with magnetic body.

FIG. 10 is a schematic bottom view of the first member 51 without illustration of a first cover 121. FIG. 11 is a schematic cross-sectional view of the first member 51 taken along a chain line X11-X11 in FIG. 10, illustration of a first permanent magnet 111 and the first cover 121 are omitted. FIG. 12 is a schematic top view of the second member 52, illustration of a second cover 122 is omitted. FIG. 13 is a schematic cross-sectional view of the second member 52 taken along a chain line X13-X13 in FIG. 12, illustration of a second permanent magnet 112 and the second cover 122 are omitted.

The first base 61 has the first housing 101 that houses the first permanent magnet 111. In some embodiments, the first housing 101 is provided to form a hollow in the axial portion 81. In some embodiments, the first housing 101 has an opening OP101 for introducing the first permanent magnet 111 from the opposite side of the end 91 (e.g. the end surface 81*a*) of the axial portion 81. The first permanent magnet 111 is introduced into the first housing 101 via the opening OP101 of the first housing 101. In some embodiments, the first housing 101 has a bottom 106 at the side of the end 91 of the axial portion 81. Note that, the first housing 101 has a circumferential wall surface 101*a* extending along the depth direction of the first housing 101 and a bottom surface 101*b* that is crossing or orthogonal to the depth direction of the first housing 101.

Cross-sectional shape of the first housing 101 in a plane orthogonal to the depth direction of the first housing 101 may take any shape such as a circle, triangle, rectangle and pentagon. It is envisioned that the cross-sectional shape of the first housing 101 changes along the depth direction of the first housing 101. Note that, the depth direction of the first housing 101 matches or is parallel to the axial direction AX1 of the axial portion 81. Note that, the axial direction AX1 of the axial portion 81 is co-axially arranged with the rotational axis AX regarding the pivoting of the second insert 72.

The bottom 106 of the first housing 101 is positioned in the proximity of the end 91 (e.g. the end surface 81*a*) of the axial portion 81. Distance between the bottom 106 of the first housing 101 and the end 91 of the axial portion 81 may be reduced, thus increasing magnetic permeability. First thinned portion 108 is provided between the end surface 81*a* of the axial portion 81 and the bottom surface 101*b* of the first housing 101. It is envisioned that one or more magnetically permeable holes are arranged in the first thinned portion 108 to further facilitate transmission of magnetic field lines there-through. The magnetically permeable holes are holes with permeability of magnetic fields and should not be limited to a space. The first thinned portion 108 is not necessarily a layer-like portion with a constant thickness.

The second base 62 has the second housing 102 that houses the second permanent magnet 112. In some embodiments, the second housing 102 of the second base 62 is provided at the opposite side relative to the receiving portion 82 of the second base 62. In some embodiments, the second housing 102 has an opening OP102 for introducing the second permanent magnet 112 from the opposite side of the opening of the receiving portion 82. The second permanent magnet 112 is introduced into the second housing 102 via the opening OP102 of the second housing 102. In some embodiments, the second housing 102 has a bottom 107 at the side of the receiving portion 82. Note that, the second housing 102 has a circumferential wall surface 102*a* extending along the depth direction of the second housing 102 and a bottom surface 102*b* crossing or orthogonal to the depth direction of the second housing 102.

Cross-sectional shape of the second housing 102 in a plane orthogonal to the depth direction of the second housing 102 can take any shape such as a circle, triangle, rectangle, and pentagon, for example. It is envisioned that the cross-sectional shape of the second housing 102 changes along the depth direction of the second housing 102. Note that the depth direction of the second housing 102 is opposite to the depth direction of the receiving portion 82.

The bottom 107 of the second housing 102 is positioned in the proximity of the bottom 92 (e.g. the bottom surface 82*a*) of the receiving portion 82. Distance between the bottom 107 of the second housing 102 and the bottom 92 of the receiving portion 82 may be reduced, thus increasing magnetic permeability. Second thinned portion 109 is provided between the bottom 92 (e.g. the bottom surface 82*a*) of the receiving portion 82 and the bottom 107 (e.g. the bottom surface 102*b*) of the second housing 102. It is envisioned that one or more magnetically permeable holes are arranged in the second thinned portion 109 to further facilitate transmission of magnetic field lines there-through. The magnetically permeable holes are holes with permeability for magnetic fields lines and should not be limited to a space. The second thinned portion 109 is not necessarily a layer-like portion with a constant thickness.

In some embodiments, the depth D101 of the first housing 101 of the first base 61 is greater than the depth D102 of the second housing 102 of the second base 62. This facilitates that the first housing 101 can have a greater accommodating space in a limited volume of the first base 61 provided with the axial portion 81. This facilitates to increase the size of the first permanent magnet 111 arranged in the first housing 101.

In some embodiments, the width W102 of the second housing 102 in a plane orthogonal to the depth direction of the receiving portion 82 is greater than the width W101 of the first housing 101 in a plane orthogonal to the axial direction of the axial portion 81. This facilitates that the second housing 102 can have a greater housing space in a limited volume of the second base 62 provided with the receiving portion 82. This facilitates to increase the size of the second permanent magnet 112 arranged in the second housing 102.

Each of the permanent magnet 111, 112 has first and second poles arranged along the rotational axis AX regarding the pivoting of the second insert 72. Arrangement direction D111, D112 (See FIG. 9) of the first and second poles in the first permanent magnet 111 and/or the second permanent magnet 112 are parallel to the rotational axis AX regarding the pivoting of the second insert 72 (See FIG. 1). The arrangement direction D111 of the first and second poles of the first permanent magnet 111 housed in the first housing 101 is parallel to the depth direction of the first housing 101 and/or the axial direction AX1 of the axial portion 81. The arrangement direction D112 of the first and second poles of the second permanent magnet 112 housed in the second housing 102 is parallel to the depth direction of the second housing 102 and/or the depth direction of the receiving portion 82.

In some embodiments, the first permanent magnet 111, housed in the first housing 101 of the first base 61, is shaped like a cylinder and, in the other hand, the second permanent magnet 112, housed in the second housing 102 of the second base 62, is shaped like a circular plate. This facilitates to allow the permanent magnet to exert greater magnetic force in a limited volume of the base portion provided with the axial portion 81 or the receiving portion 82. Likewise, in cases where the permanent magnet is replaced by magnetic body, the extent of magnetic interaction may be greater. As indicated above, one out of the two permanent magnets can be replaced by a magnetic body.

The cross-sectional shape of the first housing 101 and the cross-sectional shape of the first permanent magnet 111 (housed in the first housing 101) in a plane orthogonal to the depth direction of the first housing 101 are the same or different. Typically, both are shaped like a circle, facilitating smoother insertion of the permanent magnet into the housing. The cross-sectional shape of the second housing 102 and the cross-sectional shape of the second permanent magnet 112 (housed in the second housing 102) in a plane orthogonal to the depth direction of the second housing 102 are the same or different. Typically, both are shaped like a circle, facilitating smoother insertion of the permanent magnet into the housing.

Embodiments are envisaged where one or more position-restricting portion (e.g. a protrusion, a recess or combination of them) for restricting displacement of the permanent magnet is provided in one or both housings.

As a method for securing the first permanent magnet 111 in the first housing 101, various manners are envisioned such as gluing, fitting or closing by a cover. The same applies to a method for securing the second permanent magnet 112 in the second housing 102.

With reference to FIGS. 14-19, embodiments will be described where the opening OP101 of the first housing 101 is closed by a first cover 121, and the opening OP102 of the second housing 102 is closed by a second cover 122. In particular, embodiments will be described where the first cover 121 is secured, by fitting, to the first member 51 (or the first base 61) and the second cover 122 is secured, by fitting, to the second member 52 (or the second base 62), but should not be limited to this. For example, additionally or alternatively to the fitting, the cover can be fixed to the base portion by adhesive.

FIG. 14 is a schematic perspective view of the first cover 121. FIG. 15 is a schematic perspective view of the second cover 122. FIG. 16 is a schematic bottom view of the first member 51 in which the first cover 121 is attached to the first base 61. FIG. 17 is a schematic cross-sectional view of the first member 51 taken along a chain line X17-X17 in FIG. 16 with the first cover 121 attached to the first base 61. FIG. 18 is a schematic top view of the second member 52 with the second cover 122 attached to the second base 62. FIG. 19 is a schematic cross-sectional view of the second member 52 taken along a chain line X19-X19 in FIG. 18 with the second cover 122 attached to the second base 62.

Each of the first and second cover 121,122 has a covering portion 131 and one or more engaging protrusions 132. In the illustrated case, each cover is provided with two engaging protrusions 132. The covering portion 131 is a portion that covers the opening of the housing into which the permanent magnet or the magnetic body is inserted. The engaging protrusion 132 is a portion that prevents the cover from coming off the stop member or the base portion. Each engaging protrusion 132 has a post 133 provided on the covering portion 131 and an engagement head 134 provided at the end of the post 133. Embodiments are envisaged where the covering portion 131 is provided with a rotation stop 135 as illustrated. Note that, in the case where adhesive is used, the engaging protrusions 132 can be omitted.

The first and second bases 61,62 have third and fourth housings 103, 104 respectively that receive a respective covering portion 131 of the cover 121, 122 so that the cover is suppressed from coming off. The depth of the third and fourth housings 103,104 may be set equal to the thickness of a respective covering portion 131 of the cover 121,122. Note that the third housing 103 is in spatial communication with the first housing 101. Likewise, the fourth housing 104 is in spatial communication with the second housing 102.

In cases where each cover 121,122 is provided with the engaging protrusion 132, the first and second bases 61,62 have respective first and second engaged portions 141,142 with which the engaging protrusions 132 are respectively engaged. The first engaged portion 141 is provided radially outwardly offset from the axial direction AX1 of the axial portion 81. Therefore, when engaged with the first engaged portion 141, the engaging protrusion 132 of the first cover 121 is positioned radially outwardly offset from the axial direction AX1 of the axial portion 81. The first engaged portion 141 may be provided to penetrate through the outer peripheral surface 81*b* of the axial portion 81 and a surface of the first base 61 at the opposite side of the axial portion 81, but not necessarily limited to this. The first engaged portion 141 has a locking surface 151 by which the engagement head 134 of the engaging protrusion 132 is locked.

The second engaged portion 142 is positioned outwardly offset from the bottom 92 of the receiving portion 82. Therefore, when engaged with the second engaged portion 142, the engaging protrusion 132 of the second cover 122 is positioned outwardly offset from the bottom 92 of the receiving portion 82. The second engaged portion 142 is provided to penetrate through the outer peripheral surface 82*b* about the bottom surface 82*a* of the receiving portion 82 and a surface of the second base 62 at the opposite side of the receiving portion 82, but not necessarily limited to this. The second engaged portion 142 has a locking surface 152 by which the engagement head 134 of the engaging protrusion 132 is locked.

Operation of the stop member 50 of the present disclosure will be described with reference to FIGS. 20 and 21. FIGS. 20 and 21 are a schematic view illustrating that, while the first and second bases 61,62 are magnetically attached, the sliding portion 84 slides down a sloped surface 83 and the second insert 72 of the second member 52 moves toward the slit 46 of the slider 40. FIG. 20 illustrates a condition before the second insert 72 enters into the slider 40 via the slit 46 of the slider 40. FIG. 21 illustrates a condition after the second insert 72 has entered into the slider 40 via the slit 46 of the slider 40.

Firstly, in order to close the first and second fastener stringers 31, 32, the first and second bases 61 and 62 are overlaid. Note that, the first insert 71 has been inserted into the slider 40 beforehand. The slider 40 is held stationary on the first member 51. When the first and second bases 61 and 62 are overlaid, the second base 62 moves toward the first base 61 in accordance with the magnetic attraction effected between them. The axial portion 81 of the first base 61 enters into the receiving portion 82 of the second base 62. The sliding portion 84 touches the sloped surface 83. Reduction in the interspace between the first and second bases 61 and 62 is accompanied by sliding movement of the sliding portion 84 on the sloped surface 83. Accordingly, the second base 62 rotates relative to the first base 61 and the second insert 72 pivots about the rotational axis AX toward the slit 46 of the slider 40. Finally, the second insert 72 enters into the slider 40 via the slit 46 of the slider 40. In short, the second base 62 moves toward the first base 61 in accordance with the magnetic attraction in the axial direction of the rotational axis AX regarding the pivoting of the second insert 72, and the second insert 72 pivots about the rotational axis AX.

As shown in FIG. 21, following that the second insert 72 has entered into the slider 40 via the slit 46 of the slider 40, the slider 40 is moved frontward and the fastener stringers 31,32 are closed. In particular, the first fastener element 21 and the third fastener element 23 are engaged and in turn, the first fastener elements 21 and the second fastener elements 22 are engaged.

Magnetic attraction between the first and second bases 61 and 62 cause the rotation of the second base 62 relative to the first base 61 while the first base 61 and the second base 62 approach one another. For a person operating the stop member 50, just overlaying the first base 61 and the second base 62 would let the second insert 72 automatically pivot towards the slit 46 of the slider 40. Operational burden for inserting the second insert 72 into the slit 46 of the slider 40 would be omitted. Even if the second insert 72 failed to insert into the slit46 of the slider 40 for some reasons, operational burden for moving the second insert 72 toward the slit 46 of the slider 40 would be reduced. It is conceived that operation for moving the second insert 72 toward the slit 46 of the slider 40 is not easy for infants or elderly people. The stop member 50 of the present disclosure may be easily handled by such people.

With reference to FIGS. 22-26, embodiments will be described where the second insert 72 moves toward the slit 46 of the slider 40 based on magnetic repulsion between the first and second permanent magnets 111 and 112 of the first and second bases 61 and 62. That is, in the above descriptions, the first and second bases 61,62 are configured to effect magnetic attraction between the first and second bases 61,62 when the first and second bases 61,62 are overlaid. Also, the second base 62 rotates relative to the first base 61 in a process of magnetic attachment of the first and second bases 61,62 according to the magnetic attraction. In contrast, in the following descriptions, the first and second bases 61,62 are configured to effect magnetic repulsion when the first and second bases 61,62 are overlaid. Also, the second base 62 rotates relative to the first base 61 in accordance with the magnetic repulsion. Even in such a case, operational burden for inserting the second insert 72 into the slit 46 of the slider 40 would be omitted or reduced. Note that embodiments will be described where the first base 61 is not provided with the axial portion 81 and the sloped surface 83, and the second base 62 is not provided with the receiving portion 82 and the sliding portion 84. However, embodiments are envisioned where they are provided with these omitted portions. Note that the base portion 61,62 are portions to be overlaid, and rotation based on magnetic attraction and/or repulsion would be more easily imparted.

FIG. 22 is a schematic view of the first member 51 having the first permanent magnet 111 of bar magnet. FIG. 23 is a schematic view of the second member 52 having the second permanent magnet 112 of bar magnet. FIG. 24 is a schematic cross-sectional view illustrating an embodiment where the first permanent magnet 111 housed in the first housing 101 of the first base 61 is covered by the first cover 121 and the second permanent magnet 112 housed in the second housing 102 of the second base 62 is covered by the second cover 122. FIG. 25 is a schematic view illustrating that the first base 61 of the first member 51 and the second base 62 of the second member 52 are overlaid. The second insert 72 moves toward the slit 46 of the slider 40 in accordance with magnetic repulsion effected between the first permanent magnet 111 of the first base 61 and the second permanent magnet 112 of the second base 62. FIG. 26 is a schematic view illustrating that the second insert 72 has been inserted in the slider 40 via the slit 46 of the slider 40 in accordance with magnetic repulsion effected between the first permanent magnet 111 of the first base 61 and the second permanent magnet 112 of the second base 62. Magnetic repulsion between the first poles of the first and second permanent magnets 111 and 112 and/or between the second poles of the first and second permanent magnets 111 and 112 would be used for pivoting the second insert 72.

As shown in FIGS. 22 and 23, each of the permanent magnets 111, 112 has first and second poles arranged in a plane crossing or orthogonal to the rotational axis AX regarding the pivoting of the second insert 72. Arrangement direction D111 of the first and second poles in the first permanent magnet 111 of the first base 61 is crossing or orthogonal (i.e. non-parallel) to the rotational axis AX regarding the pivoting of the second insert 72 (See FIG. 1). Arrangement direction D112 of the first and second poles in the second permanent magnet 112 of the second base 62 is crossing or orthogonal (i.e. non-parallel) to the rotational axis AX regarding the pivoting of the second insert 72.

In some embodiments, the first and second bases 61 and 62 are engaged in rotatable manner, not necessarily limited to this though. As shown in FIG. 24, the first base 61 has one or more engaging portion 161 and the second base 62 has one or more engaged portions 162. The engaging portion 161 is a protrusion and the engaged portion is a recess, but these can be interchanged. The recess extends in the circumferential direction regarding the rotational axis AX, for example. Accordingly, rotation of the second base 62 relative to the first base 61 or rotation of the first base 61 relative to the second base 62 in accordance with magnetic force effected between the first and second permanent magnets 111 and 112 would be facilitated.

At a situation shown in FIG. 25, the first pole of the second permanent magnet 112 is positioned near the first pole of the first permanent magnet 111. Likewise, the second pole of the second permanent magnet 112 is positioned near the second pole of the first permanent magnet 111. The first and second bases 61 and 62 are sandwiched between thumb and index finger of a hand of human. Thus, the first permanent magnet 111 cannot move away from the second permanent magnet 112 along the rotational axis AX. Likewise, the second permanent magnet 112 cannot move away from the first permanent magnet 111 along the rotational axis AX. The first pole of the second permanent magnet 112 moves away from the first pole of the first permanent magnet 111 in a plane crossing or orthogonal to the rotational axis AX in accordance with magnetic repulsion effected between the same poles of the first and second permanent magnets 111 and 112 and similarly, the second pole of the second permanent magnet 112 moves away from the second pole of the first permanent magnet 111. That is, the rotation of the second base 62 relative to the first base 61 starts in accordance with magnetic repulsion effected between the same poles of the first and second permanent magnets 111 and 112. Directionality can be given to the rotational direction of the second base 62 in accordance with the adjustment of force for sandwiching them between the thumb and index finger. The second insert 72 pivots toward the slit 46 of the slider 40 in accordance with the above-described rotation of the second base 62 relative to the first base 61. It is an option for the first and second bases 61 and 62 to be associated in rotatable manner, but such a case allows one to control more easily a rotational direction of the second base 62 as described above.

FIGS. 27 to 30 describe embodiments where the second insert 72 is inserted into the slider 40 via the slit 46 of the slider 40 in accordance with magnetic attraction effected between the first and second permanent magnets 111 and 112 of the first and second bases 61 and 62. The second pole of the second permanent magnet 112 is placed near the first pole of the first permanent magnet 111 and likewise, the first pole of the second permanent magnet 112 is placed near the second pole of the first permanent magnet 111. The second pole of the second permanent magnet 112 moves closer to the first pole of the first permanent magnet 111 in a plane crossing or orthogonal to the rotational axis AX in accordance with magnetic attraction effected between the opposite poles of the first and second permanent magnets 111 and 112 and likewise, the first pole of the second permanent magnet 112 moves closer to the second pole of the first permanent magnet 111. That is, the rotation of the second base 62 relative to the first base 61 starts in accordance with magnetic attraction effected between the opposite poles of the first permanent magnet 111 and the second permanent magnet 112. This is accompanied by the second insert 72 pivoting toward the slit 46 of the slider 40. It is an option for the first base 61 and the second base 62 to be associated in rotatable manner, but such a case allows one to control more easily the rotational direction of the second base 62 as described above.

Based on the above teachings, a skilled person in the art would be able to add various modifications to the respective embodiments. Reference numbers in Claims are just for reference and should not be referred for a purpose of narrowly construing the scope of claims. Embodiments are envisioned where only magnetic repulsion is caused when the first base and the second base are overlaid, and the second insert pivots into the slit.

REFERENCE SIGNS LIST

1 Slide fastener
40 Slider
44 Front mouth
45 Rear mouth
46 Slit
51 First member
52 Second member
61 First base
62 Second base
71 First insert
72 Second insert
81 Axial portion
82 Receiving portion
83 Sloped surface
84 Sliding portion

What is claimed is:

1. A stop member comprising:

a first member including a first insert inserted into a slider via a rear mouth of the slider, and a first base positioned rearward of the first insert and including a first permanent magnet; and a second member including a second insert inserted into the slider via a slit extending between the rear mouth and a front mouth of the slider, and a second base locatable onto the first base and including a second permanent magnet, wherein the first and second bases are configured to effect (i) magnetic attraction between the first and second permanent magnets when the first and second bases are overlaid or (ii) both of magnetic attraction and repulsion between the first and second permanent magnets when the first and second bases are overlaid, and wherein the second base rotates relative to the first base in accordance with the magnetic attraction or both of the magnetic attraction and repulsion in a direction such that the second insert pivots toward the slit.

2. The stop member of claim 1, wherein the first and second bases are configured to effect magnetic attraction between the first and second bases when the first and second bases are overlaid, and wherein the second base rotates relative to the first base as the first and second bases come closer in accordance with the magnetic attraction.

3. The stop member of claim 1, wherein in accordance with the magnetic attraction, the second base moves closer to the first base in an axial direction of a rotational axis regarding the pivoting of the second insert and accordingly, the second insert pivots about the rotational axis.

4. The stop member of claim 1, wherein the first and second bases are configured to effect magnetic repulsion when the first and second base are overlaid, and the second base rotates relative to the first base in accordance with the magnetic repulsion.

5. The stop member of claim 4, wherein the first and second bases are engageable in a rotatable manner.

6. The stop member of claim 1, wherein each of the first and second permanent magnets has first and second poles arranged in a plane crossing or orthogonal to a rotational axis regarding the pivoting of the second insert.

7. The stop member of claim 1, wherein one of the first and second bases includes a sloped surface that extends about a rotational axis regarding the pivoting of the second insert, and the other one of the first and second bases includes a sliding portion that slides on the sloped surface.

8. The stop member of claim 1, wherein one of the first base and the second base is provided with an axial portion, and an other one of the first base and the second base is provided with a receiving portion that receives the axial portion.

9. The stop member of claim 8, wherein the first base is provided with the axial portion, the first base has a first housing for housing the first permanent magnet, and the first housing has a bottom positioned in a proximity of an end of the axial portion.

10. The stop member of claim 8, wherein the second base is provided with the receiving portion, the second base has a second housing for housing the second permanent magnet and the second housing has a bottom positioned in a proximity of a bottom of the receiving portion.

11. A slide fastener including the stop member of claim 1.

12. The stop member of claim 1, wherein (i) the first permanent magnet has no hole, and the second permanent magnet has no hole; and/or (ii) the second permanent magnet is thinner than the first permanent magnet.

13. The stop member of claim 1, wherein one of the first base and the second base is provided with an axial portion, and an other one of the first base and the second base is provided with a receiving portion that receives the axial portion, the axial portion being adapted to house one of the first permanent magnet and the second permanent magnet.

* * * * *